US008019244B2

(12) United States Patent
Nakane

(10) Patent No.: US 8,019,244 B2
(45) Date of Patent: Sep. 13, 2011

(54) USER-FRIENDLY IMAGE FORMING APPARATUS WITH CURRENT SUPPLIER FOR SUPPLYING CLEANING CURRENT, IMAGE FORMING METHOD AND RECORDING MEDIUM

(75) Inventor: Eiji Nakane, Okazaki (JP)

(73) Assignee: Konica Minolta Business Technologies, Inc., Chiyoda-Ku, Tokyo (JP)

( * ) Notice: Subject to any disclaimer, the term of this patent is extended or adjusted under 35 U.S.C. 154(b) by 689 days.

(21) Appl. No.: 12/133,823

(22) Filed: Jun. 5, 2008

(65) Prior Publication Data

US 2009/0022509 A1 Jan. 22, 2009

(30) Foreign Application Priority Data

Jul. 19, 2007 (JP) ..... 2007-188237

(51) Int. Cl.
*G03G 15/16* (2006.01)

(52) U.S. Cl. ..... 399/44; 399/71; 399/101

(58) Field of Classification Search ..... 399/44, 399/71, 101, 129
See application file for complete search history.

(56) References Cited

U.S. PATENT DOCUMENTS

| | | | | |
|---|---|---|---|---|
| 5,177,553 | A | 1/1993 | Ohike et al. | |
| 7,127,191 | B2 * | 10/2006 | Mori et al. | 399/101 |
| 7,215,920 | B2 * | 5/2007 | Shida | 399/101 |

FOREIGN PATENT DOCUMENTS

| | | |
|---|---|---|
| JP | 03-269477 | 12/1991 |
| JP | 04-251882 | 9/1992 |
| JP | 08-292623 | 11/1996 |
| JP | 2001175139 | 6/2001 |
| JP | 2002-214998 | 7/2002 |
| JP | 2004-053942 | 2/2004 |

OTHER PUBLICATIONS

Decision to Grant a Patent issued in corresponding Japanese Application No. 2007-188237 dated Nov. 10, 2009, and an English Translation thereof.

* cited by examiner

*Primary Examiner* — William J Royer
(74) *Attorney, Agent, or Firm* — Buchanan Ingersoll & Rooney PC

(57) ABSTRACT

An image forming apparatus includes: an intermediate transfer belt for, by rotation thereof, transferring a toner image on a surface thereof; a cleaner for removing toner particles after the transfer by rotation of a cleaning brush which touches the surface of the intermediate transfer belt and rotates during the transfer; a current supplier for supplying a cleaning current having a predetermined value (I2) to the cleaning brush in accord with the transfer; and a controller for controlling the intermediate transfer belt, cleaner and current supplier. The controller obtains a current time T1 and a previous rotation end time T2 of the cleaning brush, and when a time period during which the cleaning brush has not rotated, which is calculated from the current time T1 and the rotation end time T2, is equal to a predetermined time period or longer, sets the cleaning current to "I1".

14 Claims, 16 Drawing Sheets

FIG.16

| TEMPERATURE(℃) \ HUMIDITY (%) | LOW (B<15) | MIDDLE (15≦B<70) | HIGH (70≦B) |
|---|---|---|---|
| LOW (A<10) | 48hr | 36hr | 24hr |
| MIDDLE (10≦A<25) | 36hr | 24hr | 18hr |
| HIGH (25≦A) | 24hr | 18hr | 12hr |

USER-FRIENDLY IMAGE FORMING APPARATUS WITH CURRENT SUPPLIER FOR SUPPLYING CLEANING CURRENT, IMAGE FORMING METHOD AND RECORDING MEDIUM

This application is based on application No. 2007-188237 filed in Japan, the contents of which are hereby incorporated by reference.

BACKGROUND OF THE INVENTION

1. Field of the Invention

The present invention relates to an image forming apparatus, an image forming method and an image forming program, and in particular to technology for suppressing unevenness in dot pitch.

2. Related Art

Some image forming apparatuses include a transfer belt as an image carrier and a cleaning brush as a cleaner, and clean a surface of the transfer belt with the cleaning brush. In other words, these image forming apparatuses have a cleaning brush that is in contact with a transfer belt. When forming an image by transferring a toner image applied to the transfer belt to a sheet-like material, some toner particles may remain on the surface of the transfer belt untransferred. The above image forming apparatuses electrostatically remove these remaining toner particles (i.e., residual untransferred toner particles) by rotating the cleaning brush while receiving a cleaning current (electric current for cleaning) at a predetermined current value.

The cleaning brush is made by, for example, weaving conductive fibers into a conductive base fabric, the conductive fibers being made from nylon fibers each having a diameter of 1 to 10 deniers, and so forth. As the cleaning brush is in contact with the transfer belt, part of the bristles of the cleaning brush bends (or, is in a bent state) from touching the transfer belt.

After this bent state lasts for a long period of time (e.g., after a long vacation and the like), forming an image with use of such a cleaning brush that partially remains in the bent state would give rise to the following problem: when the cleaning brush rotates, contact resistance between the bent part of the cleaning brush and the transfer belt becomes different from contact resistance between an unbent part of the cleaning brush and the transfer belt. This makes the rotation speed of the transfer belt irregular, and dot pitch accordingly becomes uneven.

There is a technology for suppressing such an unevenness in dot pitch caused by the partially bent state of the cleaning brush due to the lengthy cessation of the rotation thereof.

According to this technology, following such a lengthy cessation of the rotation of the cleaning brush, the cleaning brush is preliminarily rotated prior to the image formation so as to restore the bent part of the cleaning brush back to the unbent state (e.g., Japanese Laid-Open Application No. 2001-175139).

However, the problem with such a conventional technology is that after the lengthy cessation of the rotation of the cleaning brush, users cannot get the printer to start the image formation until the preliminary rotation is completed; this conventional technology thereby renders such an image forming apparatus user-unfriendly.

More specifically, when the cleaning brush is made of, for example, nylon fibers, it requires about 5 to 30 minutes of preliminary rotation to restore the bent part of the cleaning brush back to the unbent state. Since the users have to face the long waiting time, such an image forming apparatus is quite user-unfriendly, especially considering the fact that it only takes about a minute to warm up an image forming apparatus of recent years.

SUMMARY OF THE INVENTION

To deal with the above problem, one aspect of the present invention aims to provide an image forming apparatus, an image forming method and an image forming program that can, even after a cleaner has not rotated for a long period of time, instantly form an image while suppressing unevenness in dot pitch.

To achieve the above object, one aspect of the image forming apparatus pertaining to the present invention is an image forming apparatus comprising (i) an image carrier operable to, by rotation thereof, transfer a toner image applied to a surface thereof to a recording medium, (ii) a residual toner cleaner operable to remove toner particles that remain on the surface of the image carrier after the transfer, by rotation of a cleaning member which is in contact with the surface of the image carrier and rotated in accord with the transfer, and (iii) a current supplier operable to supply a cleaning current to the cleaning member in accord with the rotation of the cleaning member, wherein the current supplier supplies the cleaning current at a first current value when the cleaning member has not rotated for less than a predetermined period of time, and at a second current value that is smaller than the first current value when the cleaning member has not rotated for the predetermined period of time or longer.

In the above image forming apparatus, when the cleaning member has not rotated for the predetermined period of time or longer, the cleaning current is supplied at a current value that is smaller than the first current value. Accordingly, even when the cleaning member gets partially deformed from not having rotated for a long period of time, it is possible to prevent the image carrier from rotating at an irregular speed. Therefore, even when the cleaning member has not rotated for a long period of time, the above image forming apparatus can form an image instantly while suppressing unevenness in dot pitch.

To achieve the above object, one aspect of an image forming method pertaining to the present invention is an image forming method used in an image forming apparatus that (i) applies a toner image on a surface of an image carrier in order to form an image, (ii) transfers the applied toner image to a recording medium by rotation of the image carrier, and (iii) removes toner particles that remain on the surface of the image carrier after the transfer by rotation of a cleaning member, which is in contact with the surface of the image carrier and rotated in accord with the transfer while receiving a cleaning current, wherein the cleaning current is supplied to the cleaning member at a first current value when the cleaning member has not rotated for less than a predetermined period of time, and at a second current value that is smaller than the first current value when the cleaning member has not rotated for the predetermined period of time or longer.

To achieve the above object, one aspect of a recording medium pertaining to the present invention is a recording medium for storing therein a program that makes an image forming apparatus to perform processing, wherein (i) the image forming apparatus includes: an image carrier operable to, by rotation thereof, transfer a toner image applied to a surface thereof; a residual toner cleaner operable to remove toner particles that remain on the surface of the image carrier after the transfer, by rotation of a cleaning member which is in contact with the surface of the image carrier and rotated in accord with the transfer; and a current supplier operable to supply a cleaning current to the cleaning member in accord with the rotation of the cleaning member, and (ii) the processing includes the steps of: judging whether or not the cleaning member has not rotated for a predetermined period of time or longer; and instructing the current supplier to supply the cleaning current at a first current value when it is judged in the judging step that the cleaning member has not rotated for less than the predetermined period of time, and at a second current value that is smaller than the first current value when it is judged in the judging step that the cleaning member has not rotated for the predetermined period of time or longer.

BRIEF DESCRIPTION OF THE DRAWINGS

These and other objects, advantages and features of the invention will become apparent from the following description thereof taken in conjunction with the accompanying drawings which illustrate specific embodiments of the invention. In the drawings:

FIG. 16 shows exemplary criteria for judging whether or not the cleaning brush has not rotated for a long period of time, with environmental parameters added thereto.

DESCRIPTION OF PREFERRED EMBODIMENTS

First Embodiment

The following describes one embodiment of the image forming apparatus of the present invention, in which the present invention is applied to a color printer.

1. Overall Structure

Figure 1:
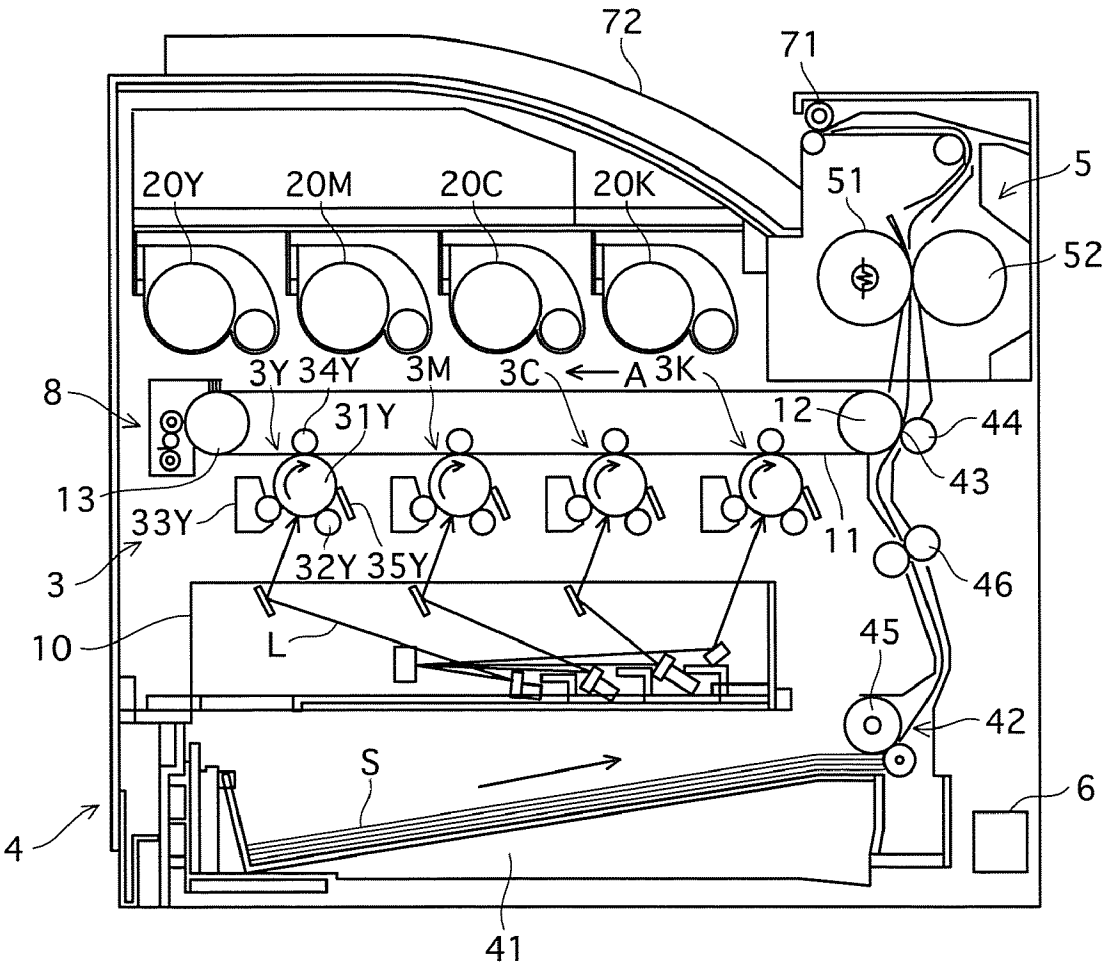
FIG. 1 shows an overall structure of a color printer pertaining to a first embodiment.

FIG. 1 shows an overall structure of a color printer 1 pertaining to the first embodiment.

As shown in FIG. 1, the color printer 1 includes: an image forming unit 3; a feed unit 4; a fixing unit 5; a control unit 6; and a cleaning unit 8, and is connected to a network (e.g., LAN). Note that the color printer 1 may be simply referred to as "printer" hereinafter. Upon receiving an instruction to execute a print job from an external terminal device (e.g., a PC and the like), the printer 1 executes, based on the instruction, the print job in color (one example of the "image formation" of the present invention) by using yellow, magenta, cyan and black toners. Hereinafter, these image forming colors yellow, magenta, cyan and black are expressed as Y, M, C and K, respectively. Components of the printer 1 that relate to these image forming colors are each numbered with one of the letters Y, M, C or K added thereto.

The image forming unit 3 includes: image forming parts 3Y, 3M, 3C and 3K that correspond to the colors yellow, magenta, cyan and black, respectively; a laser part 10; an intermediate transfer belt 11; and toner hoppers 20Y, 20M, 20C and 20K.

The image forming part 3Y includes: a photosensitive drum 31Y; a charger 32Y disposed around the photosensitive drum 31Y; a developer 33Y; a primary transfer roller 34Y; and a cleaner 35Y for cleaning the photosensitive drum 31Y. The image forming part 3Y forms a yellow toner image on the photosensitive drum 31Y. Other image forming parts 3M, 3C and 3K have the same structure as the image forming part 3Y; their numbers are omitted in FIG. 1.

The toner hoppers 20Y, 20M, 20C and 20K respectively store Y, M, C and K toners as stocks, and respectively provide their toners to the developers 33Y, 33M, 33C and 33K as necessary.

The laser part 10 includes a light-emitting element such as a laser diode, and emits laser beams L that perform exposure scanning of the photosensitive drums 31Y, 31M, 31C and 31K.

The intermediate transfer belt 11 (one example of the "image carrier" of the present invention) is an endless belt. It is stretched and supported by a drive roller 12 and a driven roller 13, and is driven to rotate in the direction of arrow A.

The feed unit 4 includes: a paper cassette 41 for storing one or more sheets of paper S; rollers 45 and 46 that pick up the papers S from the paper cassette 41 and deposit them on a paper path 42 one by one so as to send them to a secondary transfer position 43 (between the intermediate transfer belt 11 and a secondary transfer roller 44).

The control unit 6 (i) converts an image signal received from the external terminal device into a digital signal for the colors Y, M, C and K, (ii) generates a drive signal for driving the light-emitting element of the laser part 10, (iii) controls various components for printing, and (iv) controls the cleaning unit 8 that removes residual untransferred toner particles from the intermediate transfer belt 11. The task of controlling the cleaning unit 8 will be described in detail later.

The drive signal generated by the control unit 6 causes the laser part 10 to emit the laser beams L and perform the exposure scanning of the photosensitive drums 31Y, 31M, 31C and 31K, on which an electrostatic charge has been applied by the chargers 32Y, 32M, 32C and 32K, respectively. This exposure scanning forms electrostatic latent images on the photosensitive drums 31Y, 31M, 31 C and 31K. By the developers 33Y, 33M, 33C and 33K developing the latent electrostatic images, toner images in the colors Y, M, C and K are formed on the photosensitive drums 31Y, 31M, 31C and 31K, respectively.

Then, the toner images in the colors Y, M, C and K are sequentially transferred onto the intermediate transfer belt 11 by electrostatic forces acting on the primary transfer rollers 34Y, 34M, 34C and 34K. Each of the toner images in the colors Y, M, C and K is transferred to the same position of the intermediate transfer belt 11 at different timings, such that the toner images transferred onto the intermediate transfer belt 11 (primary transfer) are layered on one another. The rotation of the intermediate transfer belt 11 carries the layered toner images in the colors Y, M, C and K applied thereon to the secondary transfer position 43.

In the meantime, once the feed unit 4 has sent the paper S in accordance with the rotation timing of the intermediate transfer belt 11, the rotating intermediate transfer belt 11 and the secondary transfer roller 44 transport the paper S by holding it therebetween. The layered toner images on the intermediate transfer belt 11 are transferred onto the paper S (secondary transfer) by electrostatic forces acting on the secondary transfer roller 44. Now a full-color toner image is formed on the paper S.

After passing through the secondary transfer position 43, the paper S is transported to the fixing unit 5. In the fixing unit 5, a pair of fixing rollers 51 and 52 fixes the unfixed, full-color toner image onto the paper S by heat and pressure. The paper S is then discharged onto a discharge tray 72 via a pair of discharge rollers 71.

Meanwhile, the residual untransferred toner particles, which were not transferred to the paper S at the secondary transfer position 43 (secondary transfer) and thus remain on the intermediate transfer belt 11, are removed by the cleaning unit 8 that is provided downstream relative to the second transfer position 43.

The cleaning unit 8 may perform the cleaning right after a power-on of the printer 1 without an execution of a print job, or in concert with the print job. The print job may be simply referred to as "print" hereinafter. Also, the cleaning performed right after the power-on of the printer 1 without the execution of the print job is referred to as "a start-up cleaning," whereas the cleaning performed in concert with the execution of the print job is referred to as "a print cleaning."

2. Cleaning Unit

Figure 2:
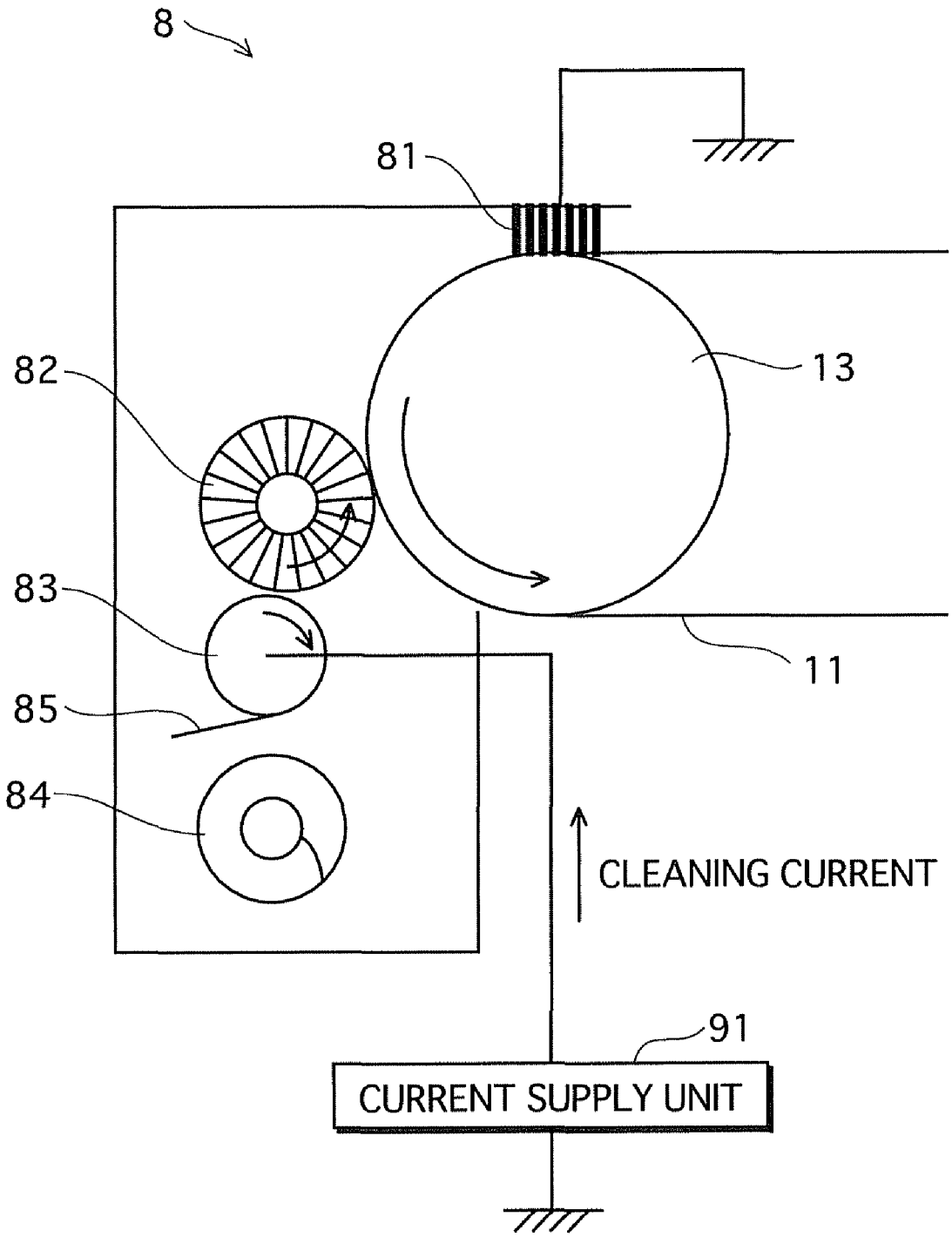
FIG. 2 shows an exemplary structure of a cleaning unit.

FIG. 2 shows an exemplary structure of the cleaning unit 8.

The cleaning unit 8 is a cleaning means that performs cleaning using electrostatic attraction. As shown in FIG. 2, the cleaning unit 8 includes: a charging brush 81; a cleaning brush 82 (one example of the "cleaner" of the present invention); a collection roller 83; and a carriage screw 84.

The control unit 6 instructs a roller drive unit (not illustrated) to drive the cleaning brush 82, the collection roller 83 and the carriage screw 84. The control unit 6 also instructs a current supply unit 91 to supply electric current to the collection roller 83. Accordingly, the collection roller 83, the cleaning brush 82 and the charging brush 81 receive the electric current (this electric current is the "cleaning current").

The charging brush 81 is provided facing an outer surface of the intermediate transfer belt 11, and charges the residual untransferred toner particles remaining on the intermediate transfer belt 11. Here, the charging brush 81 is a fixed, bar-type brush composed of a base plate and conductive fibers; the conductive fibers extend from the base plate toward the intermediate transfer belt 11, the base plate laying along the direction of the width of the intermediate transfer belt 11 (the direction perpendicular to the travelling direction of the intermediate transfer belt 11).

In the downstream direction of the charging brush 81, the cleaning brush 82 is positioned such that it is in contact with the outer surface of the intermediate transfer belt 11. The cleaning brush 82 rotates in association with the rotation of the intermediate transfer belt 11 during the print, and electrostatically removes the residual untransferred toner particles from the intermediate transfer belt 11. The peripheral speed of the intermediate transfer belt 11 may be the same as, or may be different from the rotation speed of the cleaning brush 82.

The cleaning brush 82 includes, for example, a roller that is driven to rotate, and a brush made of conductive fibers that extend radially from the surface of the roller. The cleaning brush 82 rotates on the following two occasions: when the power of the printer 1 is turned on after it had been off for a long period of time; and when the toner images on the intermediate transfer belt 11 are transferred onto the paper S.

The rotation of the cleaning brush 82 is referred to as "a start-up rotation" if it occurs when the power of the printer 1 is turned on after it had been off for a long period of time; the cleaning performed on such an occasion is the aforementioned "start-up cleaning." On the other hand, the rotation of the cleaning brush 82 is referred to as "a print rotation" if it occurs when the toner images on the intermediate transfer belt 11 are transferred onto the paper S; the cleaning performed on such an occasion is the aforementioned "print cleaning."

The collection roller 83 collects the toner particles attached to the cleaning brush 82, and is positioned such that it is in contact with the cleaning brush 82.

The current supply unit 91 has a function of supplying electric current at different current values as instructed by the control unit 6. The current supply unit 91 consists of, for example, a high-voltage power supply, a DC to DC converter, and the like.

Meanwhile, during the print cleaning, the cleaning brush 82 rotates in the opposite direction from the travelling direction of the intermediate transfer belt 11 (i.e., the cleaning brush 82 rotates in the counter direction). With the cleaning current applying high voltage to the cleaning brush 82, the intermediate transfer belt 11 forms a positive electric field on the cleaning brush 82 via the toner particles, and the charging brush 81 also forms a positive electric field on the intermediate transfer belt 11 via the toner particles.

Due to these positive electric fields, the residual untransferred toner particles, which remain on the intermediate transfer belt 11 after the secondary transfer, receive negatively charged electrons from the charging brush 81 when passing it—i.e., from the viewpoint of the intermediate transfer belt 11, the residual untransferred toner particles hold negatively charged electrons in a relative manner in the end. Accordingly, the residual untransferred toner particles are charged—i.e., the amount of charge applied to the residual untransferred toner particles increases. The residual untransferred toner particles are drawn to the cleaning brush 82 by the electrostatic attraction so as to be removed (collected).

Once the cleaning brush 82 has drawn the residual untransferred toner particles from the intermediate transfer belt 11 in the above-described manner, the residual untransferred toner particles are electrostatically collected by the collection roller 83. The residual untransferred toner particles then free-fall from the collection roller 83 by getting scraped off the same by a scraper 85, and are finally disposed of by the carriage screw 84, which is placed for toner discharge purposes below the collection roller 83.

During the print cleaning, the cleaning current is set to correspond to a quiescent period of the cleaning brush 82, the quiescent period meaning a time period for which the cleaning brush 82 has not rotated. More specifically, during the print cleaning, the cleaning current is set lower when it is supplied after the cleaning brush 82 had not rotated for a long period of time (this state is referred to as "a long quiescent period") than when it is supplied after the cleaning brush 82 had not rotated for a short period of time (this state is referred to as "a normal quiescent period"). Note that the cleaning current supplied during the start-up cleaning is the same as the cleaning current supplied during the print cleaning after the normal quiescent period.

The following describes practical examples of the cleaning current. The cleaning current supplied during the print cleaning after the normal quiescent period and the cleaning current supplied during the start-up cleaning are both set at about 20 (μA). On the other hand, the cleaning current supplied during the print cleaning after the long quiescent period is set at about 10 (μA).

In a case where the cleaning current is supplied during the print cleaning after the normal quiescent period, the amount of charge applied to the toner particles is 0 (μC/g) to −10 (μC/g) before passing the charging brush 81, and −10 (μC/g) to −40 (μC/g) after passing the charging brush 81.

Note that the cleaning brush 82 enters the long quiescent period when 12 hours or more (one example of the "predetermined time period" of the present invention) have passed since it stopped rotating.

3. Cleaning Brush

The cleaning brush 82 is made by, for example, attaching a conductive base fabric into which conductive fibers are weaved to a surface of a roller.

The conductive fibers are made by, for example, a resin material with conductive particles dispersed therein. The resin material may be nylon, polyester, acrylic material, and the like, whereas the conductive particles may be carbon, and the like.

The size, and the like of the cleaning brush 82 are properly determined depending on an object to be cleaned, such as the intermediate transfer belt 11. A practical example of the cleaning brush 82 pertaining to the present embodiment is as follows. The cleaning brush 82 has an outer diameter of 15 (mm) to (mm) and an overall length of 210 (mm) to 350 (mm), which conforms to the width of the intermediate transfer belt 11. Bristles of the cleaning brush 82 each have a length of 2 (mm) to 5 (mm). The fibers of the cleaning brush 82 may each have a diameter of 1 (denier) to 10 (deniers), a resistance of $1\times10^3$ (Ω), and a density of 50 (kF/inch$^2$) to 450 (kF/inch$^2$).

4. Control Unit

Figure 3:
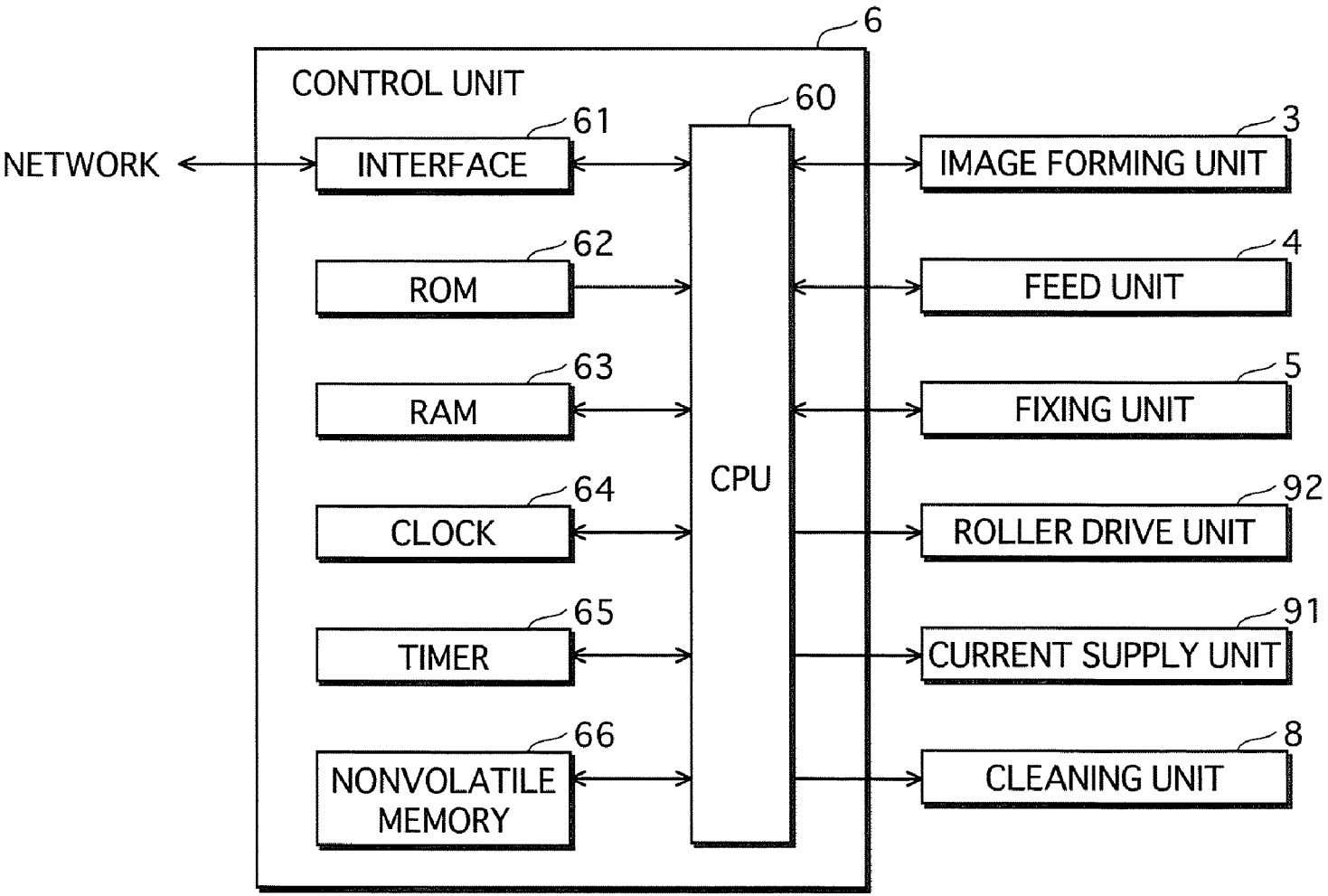
FIG. 3 is a block diagram showing a structure of a control unit.

FIG. 3 is a block diagram showing a structure of the control unit 6.

As shown in FIG. 3, the control unit 6 includes, as major components: a CPU 60; a communication interface 61; a ROM 62; a RAM 63; a clock 64; a timer 65; and a nonvolatile memory 66.

The communication interface 61 is an interface for connecting to a network, such as a LAN card.

The clock 64 measures the time in different circumstances, such as the time when the rotation of the cleaning brush 82 stopped last. The timer 65 measures a predetermined amount of time elapsed (e.g., 30 minutes) since the rotation of the cleaning brush 82 started following the long quiescent period. Note that the CPU 60 calculates the quiescent period of the cleaning brush 82 by using (i) the time when the rotation of the cleaning brush 82 stopped last (most recently) and (ii) the time when the rotation of the cleaning brush 82 first started since the rotation of the cleaning brush 82 stopped last.

The CPU 60 reads a necessary program from the ROM 62, and controls, as a whole and with precise timing, the operations of the image forming unit 3, the feed unit 4, the fixing unit 5, the cleaning unit 8, the current supply unit 91, a roller drive unit 92, and the like. Accordingly, the CPU 60 enables the printer 1 to carry out a smooth printing operation, instructs the roller drive unit 92 to rotate the cleaning brush 82, and instructs the current supply unit 91 to switch the cleaning current.

In particular, the control unit 6 judges whether the quiescent period of the cleaning brush 82 is the long quiescent period or the normal quiescent period, and in accordance with this judgment result, instructs the current supply unit 91 to supply the cleaning current to the collection roller 83.

That is to say, the above program makes the control unit 6 to perform the steps of: judging whether or not the quiescent period of the cleaning brush 82 is the long quiescent period (the predetermined time period or longer) or the normal quiescent period (shorter than the predetermined time period); and if the quiescent period of the cleaning brush 82 is judged to be the long quiescent period, instructing the current supply unit 91 to supply a cleaning current at a current value that is smaller than a predetermined value after the quiescent period of the cleaning brush 82.

Note that the cleaning current supplied during the print cleaning is referred to as "a cleaning current supplied after the long quiescent period" when it follows after the long quiescent period, and "a cleaning current supplied after the normal quiescent period" when it follows after the normal quiescent period.

Figure 4:
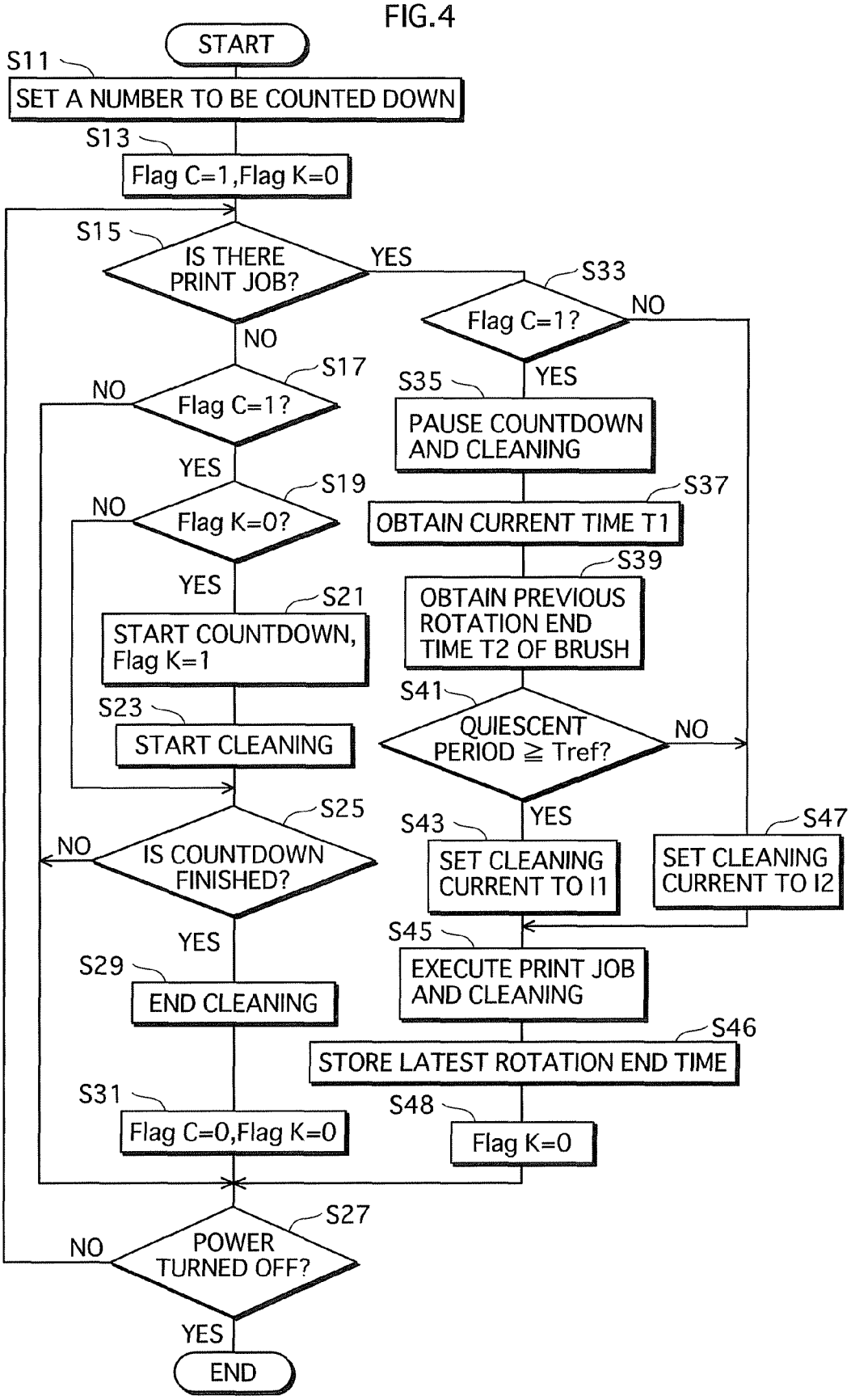
FIG. 4 shows a flowchart of a process performed by the control unit.

FIG. 4 shows a flowchart of a process performed by the control unit 6.

Upon the power-on of the printer 1, the control unit 6 sets a number to be counted down (Step S11). The control unit 6 then sets "Flag C" and "Flag K" to "1" and "0", respectively (Step S13). Here, "Flag C" indicates whether or not the start-up cleaning is necessary, and "Flag K" indicates a status of the countdown. Then, the control unit 6 judges whether or not the printer 1 has a print job to execute (Step S15).

In the present embodiment, the judgment on whether or not the start-up cleaning is finished is made based on whether or not the number set in Step S11 has been counted down to "0". "Flag C" indicates "1" during the timeframe when it is necessary to perform the start-up cleaning, and "0" after that timeframe. Meanwhile, "Flag K" indicates "1" while the countdown is on, and "0" when the countdown is off.

If the printer 1 has no print job to execute in Step S15, the control unit 6 judges whether or not "Flag C" indicates "1" (Step S17). If "Flag C" indicates "1" (the YES branch of Step S17—i.e., when it is necessary to perform the start-up cleaning) and if the countdown has not begun yet (the "YES" branch of Step S19), the control unit 6 starts the countdown, sets "Flag K" to "1" so as to show that the countdown is on (Step S21), and starts the start-up cleaning (Step S23).

More specifically, during the start-up cleaning here, the intermediate transfer belt 11 and the cleaning brush 82 are rotated, and the cleaning brush 82 receives, via the collection roller 83, the cleaning current to be supplied after the normal quiescent period. As the cleaning brush 82 rotates during this start-up cleaning, a portion of the bent part of the cleaning brush 82 is accordingly returned back to the unbent state.

The next step is to judge whether or not the countdown is finished (Step S25). If the countdown is not finished (i.e., when the start-up cleaning is not finished yet—the "NO" branch of Step S25), the control unit 6 judges whether or not the power of the printer 1 has been turned off (Step S27); if the power has not been turned off (the "NO" branch of Step S27), the control unit 6 performs the next task in Step S15.

While the start-up cleaning is being performed and the countdown is on (i.e., "Flag C"="1", "Flag K"="1"), a sequence of Steps S15 ("NO"), S17 ("YES"), S19 ("NO"), S25 ("NO"), and S27 ("NO") loops endlessly until the countdown is finished. This restores the bent part of the cleaning brush 82 mostly back to the unbent state.

If judging in Step S25 that the countdown is finished (the "YES" branch of Step S25), the control unit 6 then finishes the start-up cleaning that has been performed nondisruptively (Step S29), sets both "Flag C" and "Flag K" to "0" (Step S31), and performs the next task in Step S27.

Once the start-up cleaning is finished in the manner discussed above, "Flag C" indicates "0" and a sequence of Steps S15 ("NO"), S17 ("NO") and S27 ("NO") loops endlessly until the power of the printer 1 is turned off in Step S27 or until the printer 1 receives a print job.

If the printer 1 has a print job to perform (the "YES" branch of Step S15), the control unit 6 then judges whether or not "Flag C" indicates "1" (Step S33).

When "Flag C" indicates "1" (the "YES" branch of Step S33—when the start-up cleaning is still performed nondisruptively), the control unit 6 (i) pauses the countdown and the start-up cleaning (Step S35), (ii) obtains a current time T1 from the clock 64 and (iii) obtains, from the nonvolatile memory 66, a rotation end time T2 at which the rotation of the cleaning brush 82 stopped most recently (Steps S37 and S39).

From the current time T1 and the rotation end time T2, the control unit 6 calculates the quiescent period of the cleaning brush 82 (T1−T2). Then the control unit 6 judges whether or not the quiescent period is equal to or longer than a predetermined time period "Tref" (Step S41).

If the quiescent period is equal to or longer than the predetermined time period "Tref" (the "YES" branch of Step S41), the control unit 6 sets a current value of the cleaning current to "I1", which is the current value of the cleaning current to be supplied after the long quiescent period (Step S43). The control unit 6 then executes the print job and the cleaning (Step S45).

If the quiescent period is less than the predetermined time period "Tref" (the "NO" branch of Step S41), it means that the cleaning brush 82 has been in the normal quiescent period.

Therefore, the control unit 6 sets the current value of the cleaning current to "I2", which is the current value of the cleaning current to be supplied after the normal quiescent period (Step S47). The control unit 6 then executes the print job and the cleaning (Step S45)

When the rotation of the cleaning brush 82 stops, the control unit 6 stores, in the nonvolatile memory 66, a latest rotation end time T2 at which the cleaning brush 82 stopped just now (Step S46). The control unit 6 also sets "Flag K" to "0" (Step S48), and then performs the next task in Step S27.

Note that if "Flag C" indicates "1" in Step S33 and if the countdown and the cleaning process are paused in Step S35, "Flag K" indicates in Step S48. The control unit 6 restarts the countdown and the start-up cleaning in Steps S21 and S23 if it judges in Step S19 that "Flag K" indicates "0".

5. Unevenness in Dot Pitch

In the present embodiment, the cleaning current supplied after the long quiescent period of the cleaning brush 82 is set lower than that supplied after the normal quiescent period of the cleaning brush 82. This structure can suppress unevenness in dot pitch caused by the bent part of the cleaning brush 82, even when executing a print job after the long quiescent period of the cleaning brush 82. The following illustrates the reason why the unevenness in dot pitch can be suppressed.

(1) Source of Uneven Dot Pitch

Figure 5:
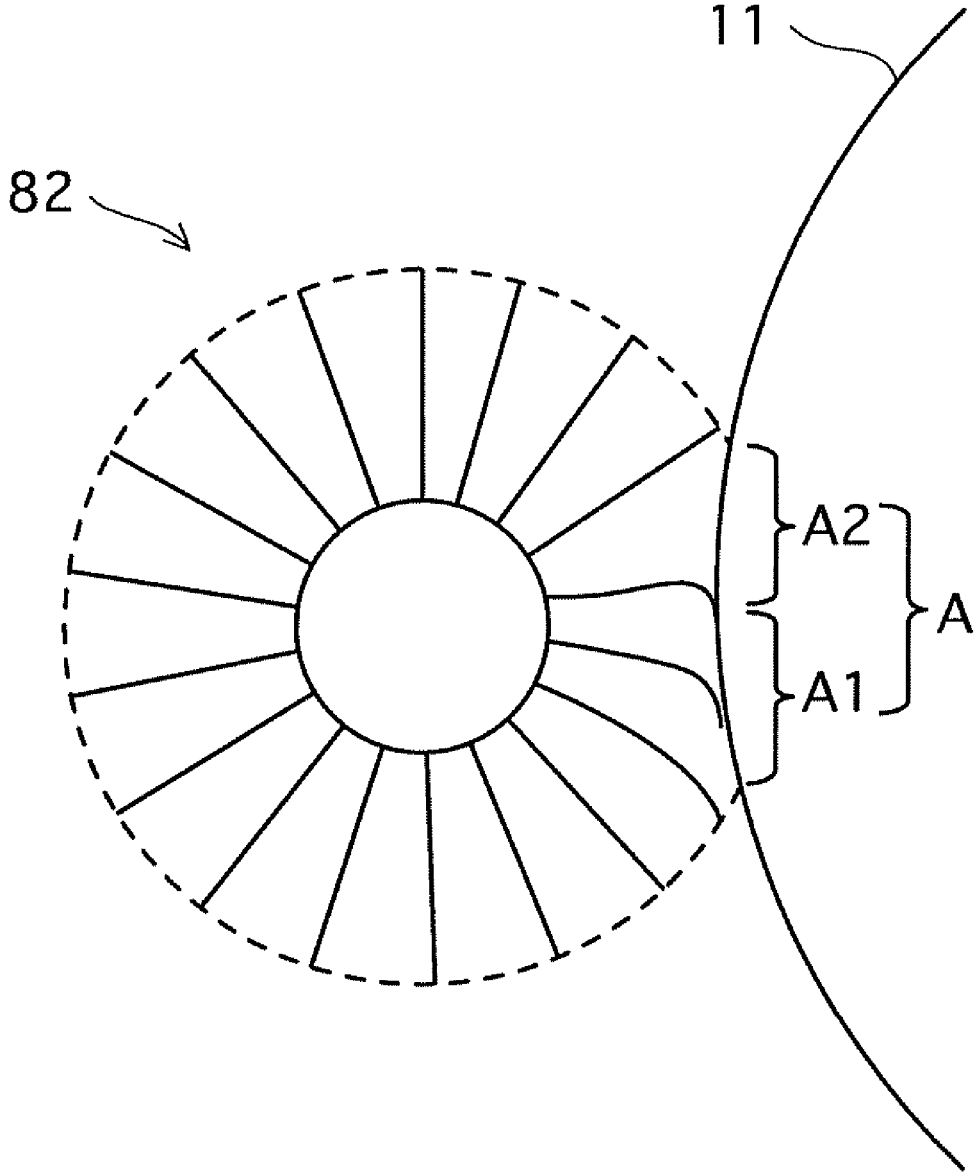
FIG. 5 shows a cleaning brush that has not rotated for a long period of time.

FIG. 5 shows the cleaning brush 82 that has been in the long quiescent period.

As the cleaning brush 82 is in contact with the intermediate transfer belt 11, part of the cleaning brush 82 that is in the contact area A (bent part) bends. For instance, in a case where the cleaning brush 82 has not rotated for a long period of time due to a long vacation and the like, the part of the cleaning brush 82 in the contact area A remains bent for a while after the cleaning brush 82 starts to rotate upon the power-on of the printer 1 (the part of the cleaning brush that remains bent is referred to as "the bent part" and is labeled "A"). It takes time to restore the bent part A back to the unbent state.

As shown in FIG. 5, the bent part A consists of A1 and A2, A1 being one side of the bent part A where the cleaning brush 82 has bent bristles, and A2 being the other side of the bent part A where the cleaning brush 82 has unbent bristles. If the cleaning brush 82 rotates with its bristles remaining partially bent, the density of the bristles is high in A1 and low in A2. Note that A1, the area of high bristle density, is referred to as a high density area A1, whereas A2, the area of low bristle density, is referred to as a low density area A2.

Furthermore, if the cleaning brush 82 rotates while remaining partially bent, the contact resistance between the cleaning brush 82 and the intermediate transfer belt 11 increases when the high density area A1 comes in contact with the intermediate transfer belt 11, and decreases when the low density area A2 comes in contact with the intermediate transfer belt 11.

Such a difference in the contact resistance makes the rotation speed of the intermediate transfer belt 11 irregular.

Figure 6A:
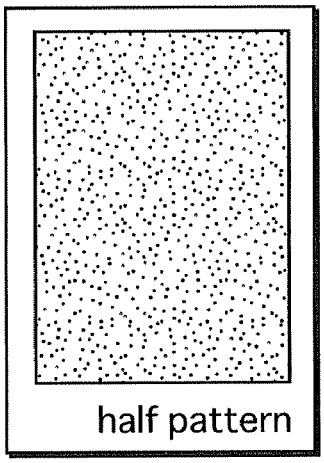
FIG. 6A shows a half pattern image which is a result of a print conducted while the cleaning brush is in an unbent state.
Figure 6B:
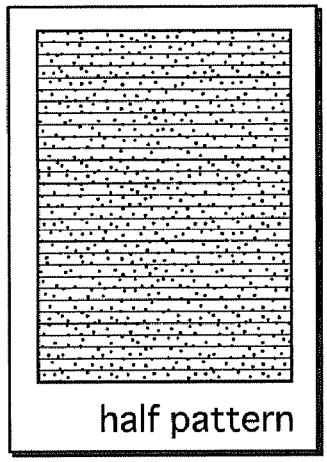
FIG. 6B shows a half pattern image which is a result of a print conducted while part of the cleaning brush is in a bent state.

FIG. 6A shows a half pattern image which is a result of a print conducted while the cleaning brush 82 is in the unbent state, and FIG. 6B shows a half pattern image which is a result of a print conducted while part of the cleaning brush 82 is in a bent state.

The half pattern image of FIG. 6A shows no sign of uneven dot pitch, assumably because the intermediate transfer belt 11 rotates at a regular speed since the cleaning brush 82 is in the unbent state.

In contrast, the half pattern image of FIG. 6B shows uneven dot pitch, assumably because the intermediate transfer belt 11 here rotates at an irregular speed since the cleaning brush 82 is partially bent.

(2) Suppressing Unevenness in Dot Pitch

The unevenness in dot pitch is assumably caused by the irregular rotation speed of the intermediate transfer belt 11, which is caused by the partially bent state of the bristles of the cleaning brush 82.

Figure 7:
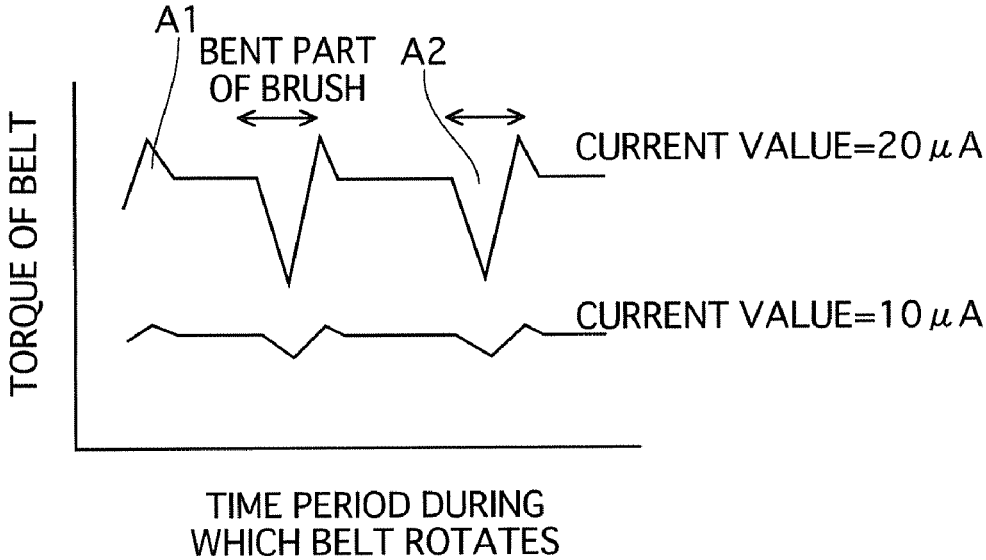
FIG. 7 shows changes in torque of a drive roller while an intermediate transfer belt is rotating.

FIG. 7 shows changes in torque of the drive roller 12 that drives the intermediate transfer belt 11.

The current value, as in "current value=20 μA" and "current value=10 μA" of FIG. 7, represents the current value of the cleaning current. The cleaning current supplied after the normal quiescent period has a current value of 20 (μA), while the cleaning current supplied after the long quiescent period has a current value of 10 (μA). In FIG. 7, the vertical axis indicates changes in the torque, while the horizontal axis indicates a time period during which the intermediate transfer belt 11 rotates.

As apparent from FIG. 7, whichever value (20 (μA) or 10 (μA)) the cleaning current has, the torque of the drive roller 12 changes periodically during the cleaning (during the rotation of the cleaning brush 82).

The following describes the reasons why the torque is subject to such changes. Once the cleaning brush 82 rotates, the low density area A2 of the bent part A comes in contact with the intermediate transfer belt 11 before the high density area A1 does. When this happens, the contact resistance between the cleaning brush 82 (low density area A2) and the intermediate transfer belt 11 decreases, with the result that the torque of the drive roller 12 drops sharply. The high density area A1 comes in contact with the intermediate transfer belt 11 next, drastically increasing the contact resistance between the cleaning brush 82 (high density area A1) and the intermediate transfer belt 11. Consequently, the torque of the drive roller 12 rises.

It is apparent that the torque is higher and the changes in the torque is more drastic when the cleaning current has a current value of 20 (μA) than when the cleaning current has a current value of 10 (μA). The reason for which lies in the fact that, as the residual untransferred toner particles are removed electrostatically, the higher value the cleaning current has, the larger the contact resistance becomes between the cleaning brush 82 and the intermediate transfer belt 11, and accordingly, the higher the torque becomes.

Hence, when the bent part A remains in the cleaning brush 82, the changes in the torque of the drive roller 12 can be kept minimal by setting the cleaning current low. The smaller the changes in the torque are kept, the less irregular the rotation speed of the intermediate transfer belt 11 becomes. This can reduce the unevenness in dot pitch.

In the case where the cleaning current is supplied after the long quiescent period of the cleaning brush 82, the printer 1 of the present embodiment sets the cleaning current low. This structure can reduce the unevenness in dot pitch regardless of the partially bent state of the cleaning brush 82.

6. Quiescent Period of Cleaning Brush 82

Figure 8:
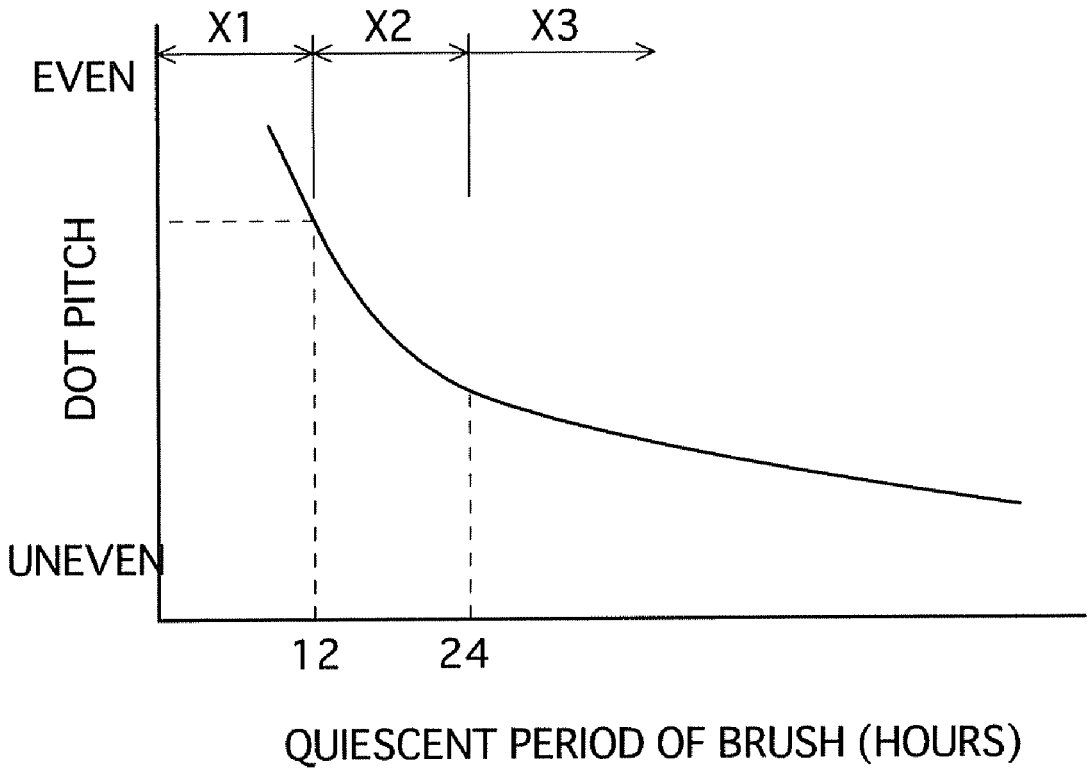
FIG. 8 shows a relationship between a time period for which the cleaning brush has not rotated and unevenness in dot pitch.

FIG. 8 shows a relationship between the quiescent period of the cleaning brush 82 and unevenness in dot pitch.

It is apparent from FIG. 8 that the longer the quiescent period of the cleaning brush 82 is, the more uneven the dot pitch becomes. If the quiescent period is within 12 hours (the X1 range of FIG. 8), it is considered that the print will yield no unevenness in dot pitch. That is to say, whether or not the print yields unevenness in dot pitch relies, to some extent, on whether or not the quiescent period of the cleaning brush 82 exceeds 12 hours. In the first embodiment, "Tref" of Step S41 in FIG. 4 can be 12 hours.

7. Exemplary Modifications

According to the above embodiment, if the quiescent period of the cleaning brush 82 is 12 hours or longer, the current value of the cleaning current to be supplied is set to about half the current value of the cleaning current supplied after the normal quiescent period. However, the current value of the cleaning current may be set such that it gradually changes depending on the length of the quiescent period of the cleaning brush 82. Described below is an exemplary modification 1 pertaining to the first embodiment.

A printer of the exemplary modification 1 supplies the cleaning current at (i) a first current value if the quiescent period of the cleaning brush 82 is a normal quiescent period, which is shorter than a first time period, (ii) a second current value, which is lower than the first current value, if the quiescent period is a first long quiescent period, which is equal to the first time period or longer but shorter than a second time period, and (iii) a third current value, which is lower than the second current value, if the quiescent period is a second long quiescent period, which is equal to the second time period or longer.

Specifically, the normal quiescent period, the first long quiescent period and the second long quiescent period are indicated by the "X1", "X2" and "X3" ranges in FIG. 8, respectively.

The first current value is 20 (μA), which is the same as the current value of the cleaning current supplied after the normal quiescent period in the first embodiment. The second current value is 15 (μA). The third current value is 10 (μA), which is the same as the current value of the cleaning current supplied after the long quiescent period in the first embodiment.

As set forth, the current value of the cleaning current is set here such that it changes gradually over three steps depending on the length of the quiescent period of the cleaning brush 82. However, it is permissible to set the current value such that it changes gradually over four steps or more.

Or, lengths of the quiescent period and values of the cleaning current may be in one-to-one correspondence. This structure can be achieved by (i) creating a table that contains, in one-to-one correspondence, different lengths of the quiescent period and different current values of the cleaning current, (ii) storing the table into a ROM, and (iii) based on the table, reading out and supplying a cleaning current that corresponds to a quiescent period at the time.

Second Embodiment

Structure, etc.

The description of the first embodiment states that, during the long quiescent period of the cleaning brush 82, if there is no print job to execute, the printer 1 rotates only the cleaning brush 82 so as to restore the bent part of the cleaning brush 82 back to the unbent state. However, a printer of the second embodiment does not have a function of driving and rotating only the cleaning brush 82 for restoring the bent part of the cleaning brush 82 back to the unbent state. More specifically, the second embodiment describes a color printer that only performs a print cleaning—i.e., that does not perform a start-up cleaning.

In terms of the mechanical structure and the like, the printer of the second embodiment is basically the same as the printer of the first embodiment. However, in the second embodiment, what is controlled by a control unit is different; the printer of the second embodiment restores the bent part of the cleaning brush 82 back to the unbent state by rotating the cleaning brush 82 during the print cleaning.

The following describes the control unit of the second embodiment.

Figure 9:
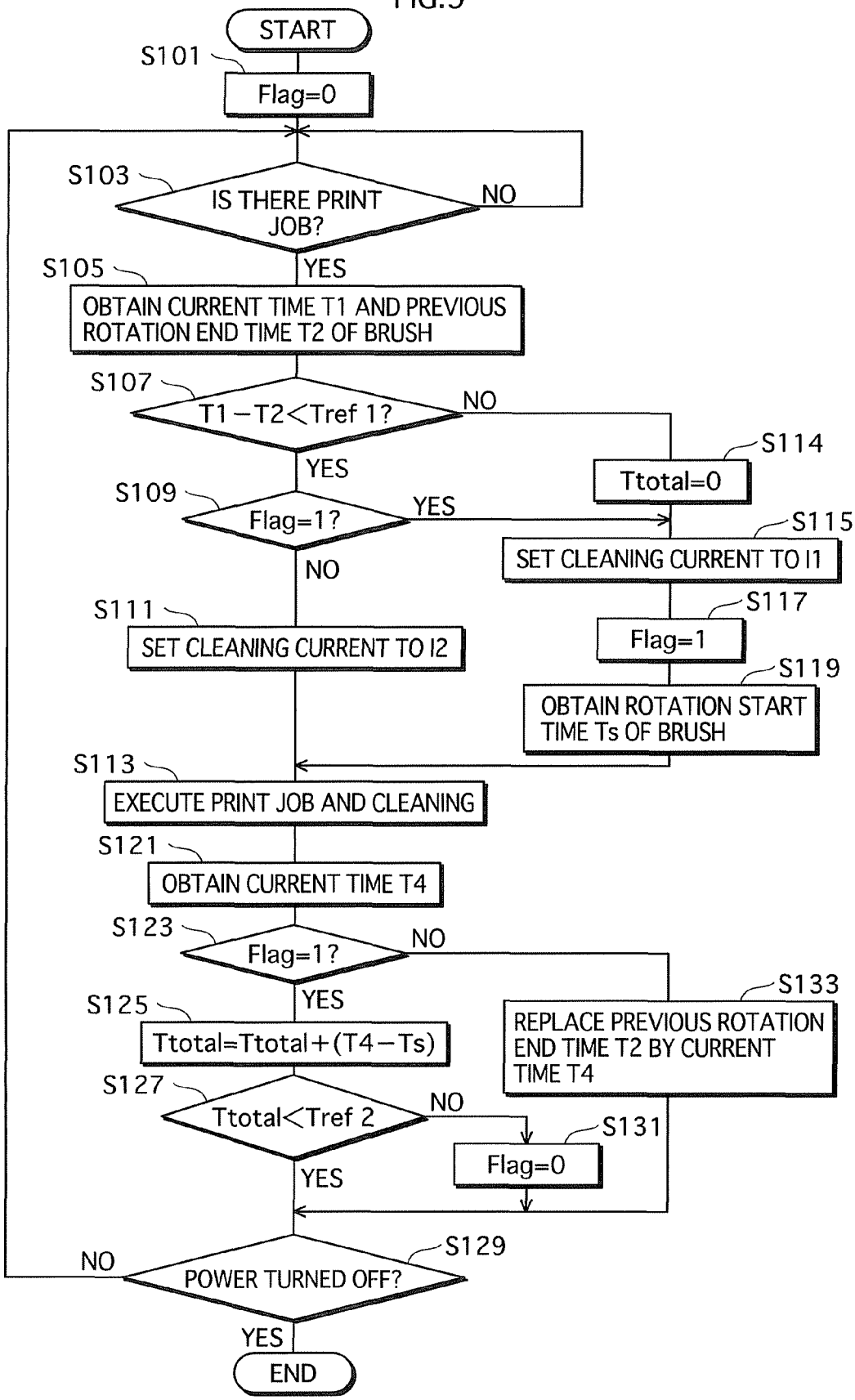
FIG. 9 shows a flowchart of a process performed by a control unit pertaining to a second embodiment.

FIG. 9 shows a flowchart of a process performed by the control unit of the second embodiment.

Upon the power-on of the printer, the control unit sets "Flag", which indicates whether or not the printer is currently in a low-current period, to "0" (Step S101) and waits to receive a print job (Step S103).

The low-current period is a time period that follows after the long quiescent period of the cleaning brush 82. During the low-current period, the cleaning current is set lower than the cleaning current supplied after the normal quiescent period, until the bent part of the cleaning brush 82 is restored back to the unbent state.

If there is a print job to execute (the "YES" branch of Step S103), the control unit obtains (i) a current time T1 and (ii) a rotation end time T2 at which the rotation of the cleaning brush 82 stopped most recently (Step S105).

From the current time T1 and the rotation end time T2, the control unit calculates the quiescent period of the cleaning brush (T1−T2). The control unit then judges whether or not the quiescent period is shorter than a predetermined time period "Tref1" (Step S107).

When the quiescent period (T1−T2) is shorter than the predetermined time period "Tref1" (the "YES" branch of Step S107), the cleaning brush 82 is in the normal quiescent period. In this case, the control unit further judges whether or not the printer has a print job to execute during the low-current period—i.e., whether or not "Flag" indicates "1" (Step S109).

If "Flag" does not indicate "1" (the "NO" branch of Step S109—when the printer is currently not in the low-current period), the control unit then sets the cleaning current to "12", which is the cleaning current to be supplied after the normal quiescent period (Step S111) and executes the print job and the cleaning (Step 113).

When the quiescent period (T1–T2) is equal to or longer than the predetermined time period "Tref1" (the "NO" branch of Step S107), the cleaning brush 82 is in the long quiescent period. In this case, the control unit sets "Ttotal" to "0" (Step S114), "Ttotal" indicating total time elapsed since the cleaning brush 82 started to rotate. The control unit then (i) sets the cleaning current to "I1", which is lower than the cleaning current "I2" supplied after the normal quiescent period (Step S115), (ii) sets "Flag" to "1" so as to show that the printer is currently in the low-current period (Step S117), and (iii) after obtaining a rotation start time Ts (Step S119), executes the print job and the cleaning (Step S113).

On the other hand, if judging "Flag" indicates "1" (the "YES" branch of Step S109—when the printer is currently in the low-current period), the control unit sets the cleaning current to "I1", which is lower than the cleaning current "I2" supplied after the normal quiescent period (Step S115).

When the cleaning is finished in Step S113, the control unit obtains a current time T4 (Step S121) and judges whether or not "Flag" indicates "1" (Step S123).

If "Flag" indicates "1" (the "YES" branch of Step S123), the control unit adds a time period for which the cleaning brush 82 had rotated in Step S113 (T4–Ts) to the total time (Ttotal) by using the current time T4 obtained in Step S121 (Step S125), and then judges whether or not the after-addition total time (Ttotal) is shorter than "Tref2", which represents a time required to restore the bent part of the cleaning brush 82 back to the unbent state (Step S127).

If the after-addition "Ttotal" is shorter than "Tref2" (the "YES" branch of Step S127—i.e., when the bent part of the cleaning brush 82 has not been restored back to the unbent state yet), the control unit judges whether or not the power of the printer has been turned off (Step S129); if the power has not been turned off (the "NO" branch of Step S129), the control unit 6 re-performs the task of Step S103.

On the other hand, if judging in Step S127 that the after-addition "Ttotal" is equal to or longer than "Tref2" (the "NO" branch of Step S127), the control unit regards that the bent part of the cleaning brush 82 has been restored back to the unbent state (i.e., the low-current period is over). Accordingly, the control unit sets "Flag" to "0" (Step S131) and then performs the task of Step S129.

If judging in Step S123 that "Flag" does not indicate "1" (the "NO" branch of Step S123"), the control unit replaces the rotation end time T2 by the current time T4 obtained in Step S121 (Step S133) and performs the next task in Step S129.

If judging in Step S129 that the power of the printer has been turned off (the "YES" branch thereof), the control unit ends the process.

In a case where the printer executes a print job for the first time in the long quiescent period of the cleaning brush 82 since the power-on of the printer 1, the control unit obtains in Step S105 (i) a current time T1 upon execution of the print job and (ii) a rotation end time T2 at which the rotation of the cleaning brush 82 stopped most recently. The control unit then calculates the quiescent period of the cleaning brush 82 (T1–T2) and judges, in Step S107, whether or not the quiescent period (T1–T2) is shorter than the predetermined time period "Tref1". Here, if judging the quiescent period is equal to or longer than the predetermined time period, the control unit sets the total time "Ttotal" to "0" in Step S114 so as to initiate the low-current period upon the execution of the print job, whether the printer has already been in the low-current period or not.

In sum, according to the present embodiment, the printer enters the low-current period not only upon executing the print that follows the power-on after the power-off state had lasted for a long period of time, but also when the cleaning brush 82 has been in the long quiescent period while the power of the printer is on.

The printer thereby can suppress unevenness in dot pitch caused by the bent part of the cleaning brush 82, not only when the power of the printer has been off for a long period of time, but also when the cleaning brush 82 has been in the long quiescent period while the power of the printer is on.

The following describes a specific structure of the printer pertaining to the second embodiment. Descriptions of some features of the structure pertaining to the second embodiment are omitted here if they are identical to those pertaining to the first embodiment. Only the features that are different from those of the first embodiment are described below.

Just like as described in the first embodiment, the cleaning brush 82 enters the long quiescent period when 12 hours or more have passed since it stopped rotating. Once the cleaning brush 82 enters the long quiescent period, the bent part thereof triggers uneven dot pitch. The low-current period is set to 40 minutes. The current value of the cleaning current supplied after the normal quiescent period, the current value of the cleaning current supplied after the long quiescent period, and the like are the same as those of the first embodiment.

2. Low-Current Period

Figure 10:
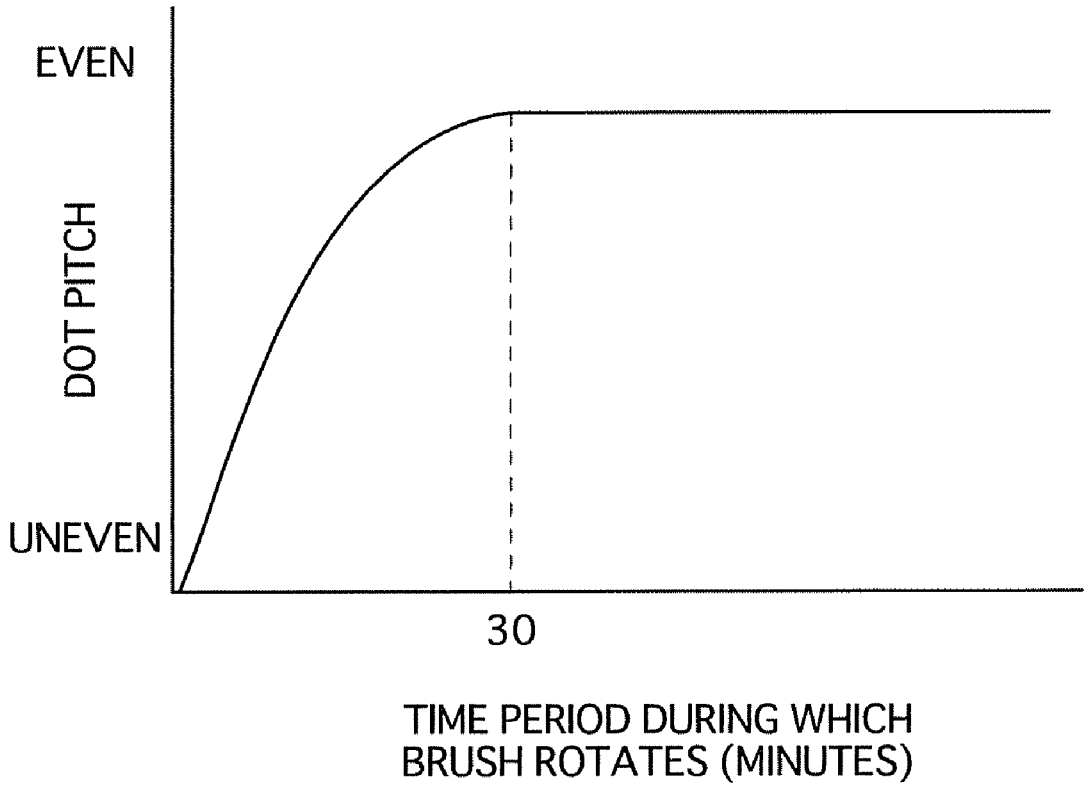
FIG. 10 shows a relationship between a time period during which the cleaning brush rotates and unevenness in dot pitch.

FIG. 10 shows a relationship between a time period during which the cleaning brush 82 rotates (hereinafter, simply "rotation time period of the cleaning brush 82") and unevenness in dot pitch.

In FIG. 10, the horizontal axis indicates the rotation time period of the cleaning brush 82 after a 24-hour quiescent period of the cleaning brush 82. The vertical axis indicates unevenness in dot pitch of an image printed after the rotation time period.

As apparent from FIG. 10, in a case where the print is executed after the long quiescent period, the unevenness in dot pitch shown in the printed image is decreased once the rotation time period of the cleaning brush 82 hits 30 minutes. This means that the bent part of the cleaning brush 82, which is caused by the long quiescent period of the cleaning brush 82, can be restored back to the unbent state by rotating the cleaning brush 82 for about 30 minutes.

That is to say, at least 30 minutes is enough time for the low-current period, which follows the long quiescent period of the cleaning brush 82.

It should be noted that the result shown in FIG. 10 is obtained when the cleaning brush 82 is made of nylon. Under different conditions, such as when the cleaning brush 82 is made of other materials, or when the cleaning brush 82 rotates faster, it takes a different amount of time for the bent part of the cleaning brush 82 to revert to the unbent state. Therefore, it is best to perform experiments beforehand so as to set the low-current period in a proper length.

In the second embodiment, as illustrated in FIG. 10, the rotation time period of the cleaning brush 82 is used as an indicator that indicates when the bent part of the cleaning brush 82 is restored back to the unbent state. Stated another way, the bent part of the cleaning brush 82 can be restored back to the unbent state by rotating the cleaning brush 82 for a predetermined time period or longer. Stated yet another way, the rotation number of the cleaning brush 82 that is equivalent to the above predetermined time period may be used as such an indicator.

The following briefly describes an implementation of an exemplary modification 2 in which the aforementioned rotation number of the cleaning brush 82 is used as the indicator. In the case where the rotation number of the cleaning brush 82 is used as the indicator, the predetermined time period of the present invention represents a time required for the total rotation number of the cleaning brush 82 to reach a predetermined number.

To implement the exemplary modification 2, the control unit should count the rotation number of the cleaning brush 82 during the print cleaning. The low-current period should be set such that it ends when the counted rotation number reaches the predetermined number.

More specifically, in FIG. 9, "Ttotal=0" is replaced by "K=PRESET VALUE" in Step S114, "Ttotal=Ttotal+(T4−Ts)" is replaced by "K=K−1" in Step S125, and the control unit judges whether or not "K=0?" in Step S127.

In Step S119, the control unit originally obtains a time that is necessary in calculating the rotation time period of the cleaning brush 82; this, however, is not necessary when reducing the counted rotation number in accordance with the rotations of the cleaning brush 82.

Third Embodiment

Structure, etc.

The first and second embodiments have described, as an example, the printer that suppresses unevenness in dot pitch caused by the bent part of the cleaning brush 82 in the following manner: the cleaning current supplied while the cleaning brush 82 is partially bent is set lower than the cleaning current supplied after the normal quiescent period.

However, as a result of setting the cleaning current lower than that supplied after the normal quiescent period, cleaning performance will deteriorate.

The third embodiment describes a color printer that can suppress unevenness in dot pitch without lowering the cleaning performance.

The printer pertaining to the third embodiment has the same mechanical structure as that pertaining to the first embodiment. However, when performing the print cleaning, the printer pertaining to the third embodiment performs only the cleaning and does not actually accompany the print.

Described below is a control unit pertaining to the third embodiment.

Figure 11:
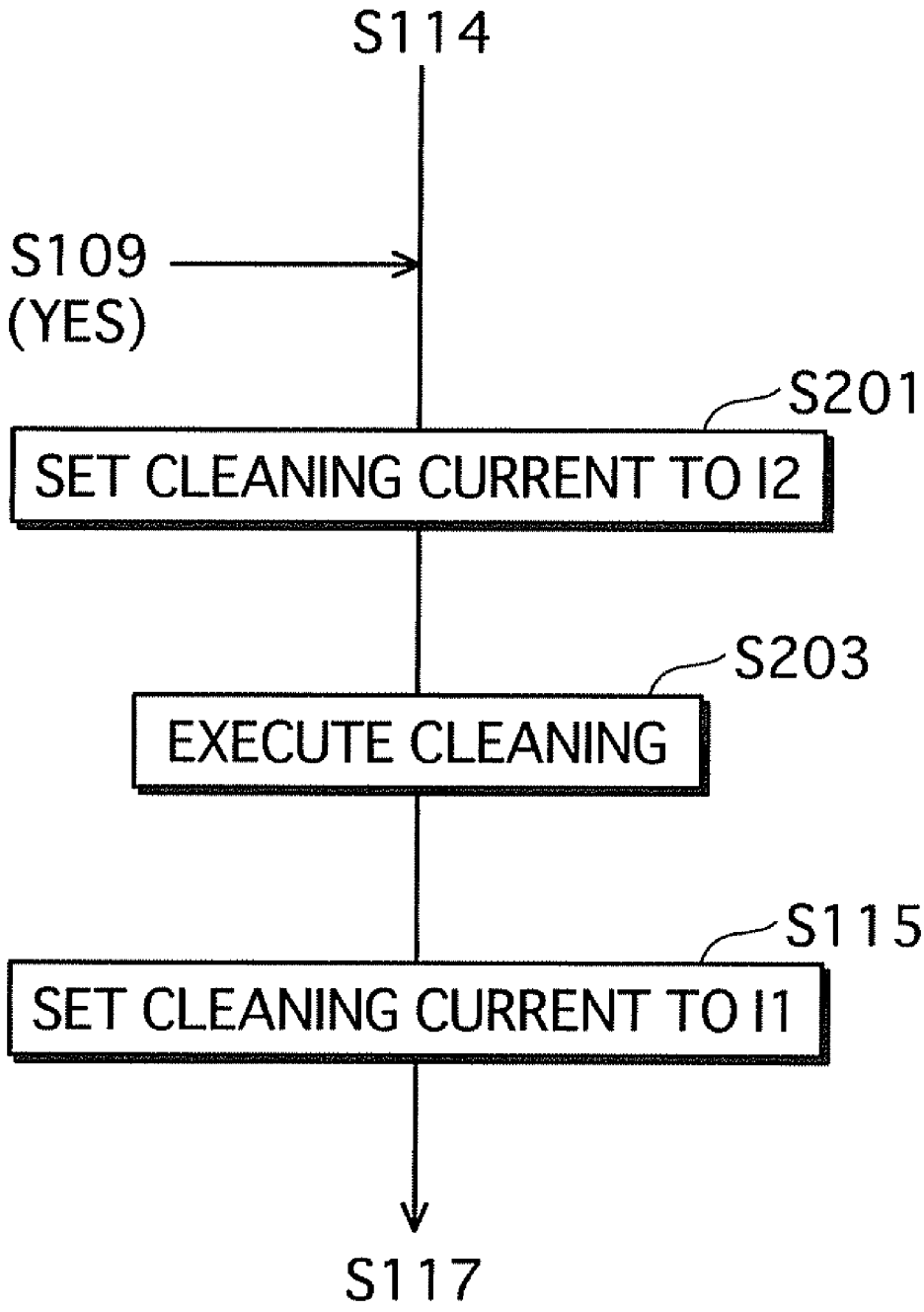
FIG. 11 shows a flowchart of a process performed by a control unit pertaining to a third embodiment.

FIG. 11 shows a flowchart of a process performed by the control unit pertaining to the third embodiment.

The control unit of the third embodiment mostly performs the process shown in the flowchart of FIG. 9. The difference is, if judging "YES" in Step S109 or setting "Ttotal" to "0" in Step S114, the control unit of the third embodiment performs the tasks of Steps S201 and S203 shown in FIG. 11 before going to Step S115.

In Step S201, the control unit sets a current value of the cleaning current to "I2", which is the current value of the cleaning current supplied after the normal quiescent period, so as to make the cleaning performance of the cleaning current equal to that supplied after the normal quiescent period. The control unit then performs the cleaning in Step S203. Here, the control unit may perform the cleaning during a time period which is required for the intermediate transfer belt 11 to rotate once or twice.

After performing the cleaning without accompanying the print, the control unit sets, in Step S115, the current value of the cleaning current to "I1" that is lower than the current value "I2" of the cleaning current supplied after the normal quiescent period, and then performs the task of Step S117 shown in FIG. 9.

In the present embodiment, the control unit performs the cleaning both in Steps S113 and S203. As the cleaning brush 82 rotates more here, it is permissible to set the low-current period shorter than that of the second embodiment.

Image Quality

Figure 12:
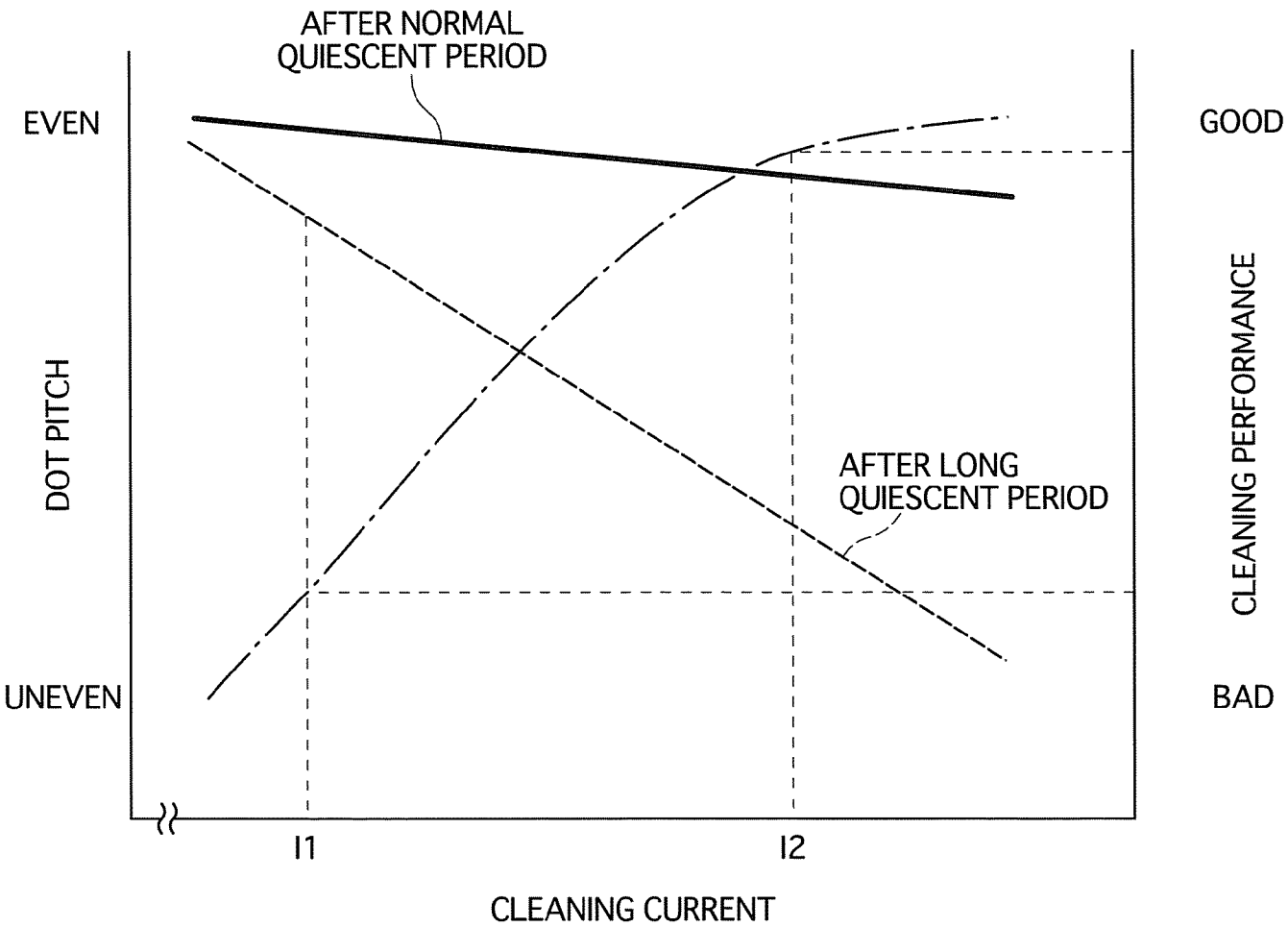
FIG. 12 shows a relationship between a cleaning current and unevenness in dot pitch, as well as a relationship between the cleaning current and a cleaning performance.

FIG. 12 shows a relationship between a cleaning current and unevenness in dot pitch, as well as a relationship between the cleaning current and cleaning performance.

(1) Unevenness in Dot Pitch

A solid line drawn in FIG. 12 indicates that if the print job is executed after the normal quiescent period, dot pitch tends to become uneven as the cleaning current increases. However, the solid line also indicates that all in all, the unevenness in dot pitch is relatively kept decent (small) regardless of the change in the cleaning current. Contrarily, a dashed line drawn in FIG. 12 indicates that if the print job is executed after the long quiescent period, the change in the cleaning current significantly affects the dot pitch. With the current value of the cleaning current supplied after the normal quiescent period ("I2" in FIG. 12), the dot pitch becomes uneven.

However, as described in the first embodiment, if the current value of the cleaning current supplied during the print that follows the long quiescent period is set to half the current value of the cleaning current supplied after the normal quiescent period ("I1" in FIG. 12), the unevenness in dot pitch is almost equal to, and as decent as, that resulting from the cleaning current supplied during the print after the normal quiescent period.

The reason why the unevenness in dot pitch can be suppressed by lowering the cleaning current is stated in the <5. Unevenness in Dot Pitch> section of the first embodiment.

(2) Cleaning Performance

The cleaning unit 8, which is one embodiment of the present invention, performs cleaning using electrostatic attraction. A chain line drawn in FIG. 12 indicates that the cleaning performance improves as the cleaning current increases.

Having regard to the above, although stated in the foregoing embodiments and exemplary modifications (hereinafter, simply "embodiments") that setting the cleaning current supplied during the print that follows the long quiescent period lower than the cleaning current supplied after the normal quiescent period is effective in suppressing the unevenness in dot pitch, this is undesirable in terms of the cleaning performance.

(3) Suppressing Unevenness in Dot Pitch and Improving Cleaning Performance

The printer pertaining to the third embodiment suppresses unevenness in dot pitch by lowering the cleaning current supplied after the long quiescent period than that supplied after the normal quiescent period. This would usually yield lower cleaning performance. However, since the printer performs, prior to the print, the cleaning without accompanying the print, it can remove residual untransferred toner particles from the intermediate transfer belt 11. This, as a result, can improve the cleaning performance.

Although the printer pertaining to the third embodiment performs, prior to the print, the cleaning without accompanying the print, it may instead perform such a cleaning after the print. Furthermore, in a case where the printer performs the cleaning without accompanying the print twice or more, it may perform each cleaning before and after the print respectively.

In the third embodiment, the cleaning current supplied when the cleaning is performed without accompanying the print has the same current value as the cleaning current supplied after the normal quiescent period. This, however, is not a limitation of the third embodiment. Specifically, the cleaning that does not accompany the print is performed for the purpose of supplementing the deterioration in the cleaning performance caused by the lowering of the cleaning current during the print. It is true that the cleaning performance is closely connected to a cleaning frequency. However, it is also true that, when performing the cleaning without accompanying the print, the printer can enhance the cleaning performance with a cleaning current that is higher than that supplied after the long quiescent period, compared to when not performing the same.

<Summary>

Although the foregoing has described the present invention based on the above embodiments, the specific examples illustrated in the above embodiments should not be construed as limiting the present invention. For instance, the following exemplary modifications may be made to the present invention.

1. Image Forming Apparatus

The above embodiments have described the case where a tandem color printer is used as the image forming apparatus. However, the image forming apparatus of the present invention may be a four-cycle type color printer, which includes one photosensitive drum and produces a full-color image by rotating an intermediate transfer belt four times, or it may be a color printer that transfers a full-color image applied to a photosensitive drum directly to a sheet-like material.

Further, the image forming apparatus may be a monochrome printer using an intermediate transfer belt, or a monochrome printer that transfers a monochrome image from a photosensitive drum to a sheet-like material.

Further, the image forming apparatus is not limited to a printer; it may instead be, for example, a facsimile apparatus that reads a scanned document (image) and outputs a received facsimile (image formation), or an apparatus such as a copier that copies a scanned document (image formation). Or, the image forming apparatus may be a complex apparatus, such as MFP (Multi Function Peripheral), into which any or all of the above-described apparatuses are combined.

2. Image Carrier

The above embodiments have described the image forming apparatus using the intermediate transfer belt, which is one example of the image carrier. However, the image carrier of the present invention may be something other than the intermediate transfer belt; for example, it may be a photosensitive drum. Or, the intermediate transfer belt and the photosensitive drum may together constitute the image carrier. Described below is an exemplary modification 3, in which the image forming apparatus uses a photosensitive drum as the image carrier.

Figure 13:
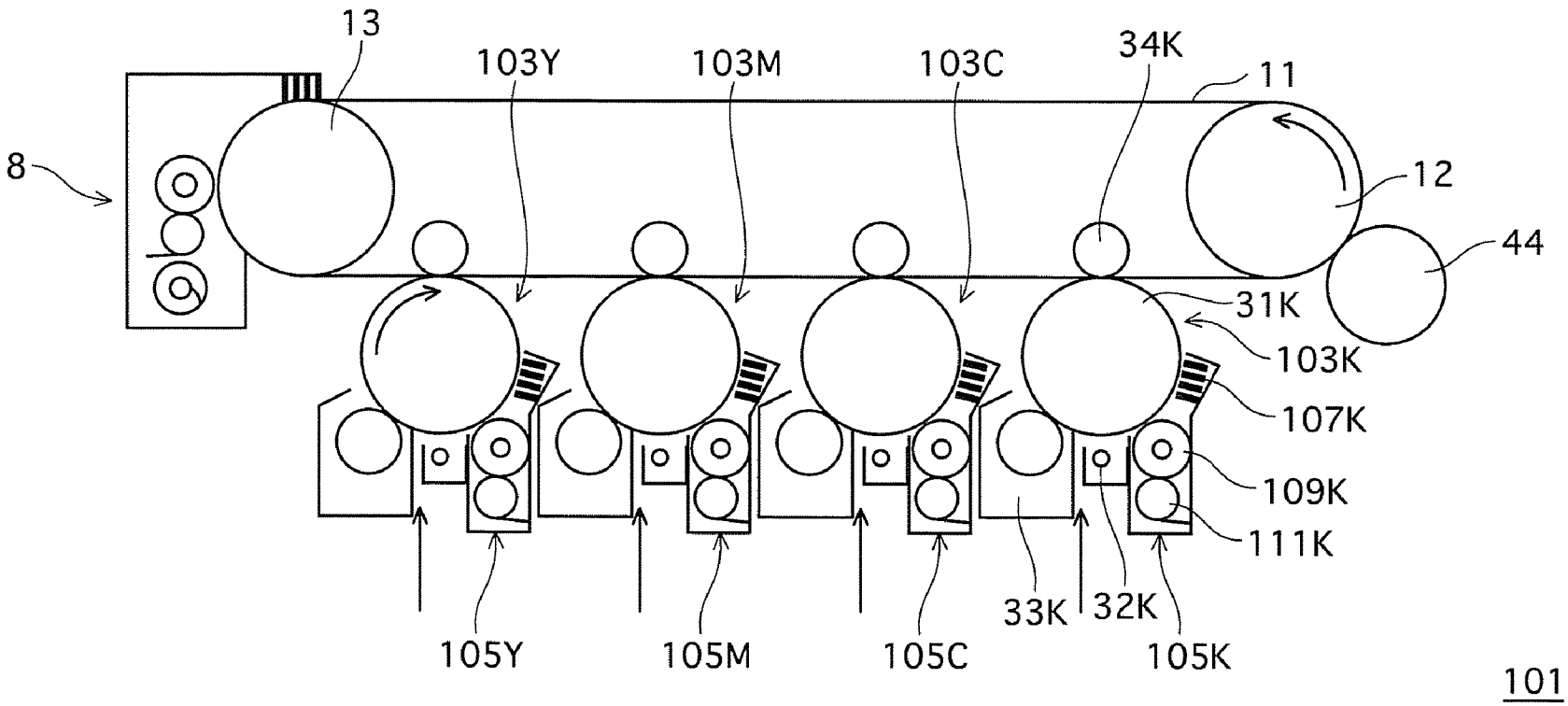
FIG. 13 shows a schematic view of an image forming unit pertaining to an exemplary modification 3.

FIG. 13 shows a schematic view of an image forming unit of a color printer pertaining to the exemplary modification 3.

The printer of the exemplary modification 3 has the same structure as the printer 1 of the first embodiment, except the cleaning device for the photosensitive drums of the image forming unit 3. The following describes an image forming unit 101 pertaining to the present exemplary modification 3.

The image forming unit 101 includes: image forming parts 103Y, 103M, 103C and 103K; a laser part; and the intermediate transfer belt 11. The intermediate transfer belt 11 is cleaned by the cleaning unit 8 of the first embodiment. As the image forming parts 103Y, 103M, 103C and 103K all have the same structure, the following describes the image forming part 103K as representing the rest.

Just as described in the first embodiment, the image forming part 103K includes: the photosensitive drum 31K; the charger 32K disposed around the photosensitive drum 31K; the developer 33K; the primary transfer roller 34K; and a cleaning part 105K for cleaning the photosensitive drum 31K.

The cleaning part 105K includes: a charging brush 107K; a cleaning brush 109K (equivalent to the "cleaner" of the present invention); and a collection roller 111K. A current supply unit (not illustrated) supplies a cleaning current to the collection roller 111K. Consequently, the collection roller 111K, the cleaning brush 109K and the charging brush 107K receive the cleaning current.

As stated earlier, in the cleaning part 105K of the exemplary modification 3, the cleaning current supplied during the image formation is set to correspond to a quiescent period of the cleaning brush 109K, the quiescent period meaning a time period for which the cleaning brush 109K has not rotated.

It should be noted here that the system of the cleaning unit 8 for cleaning the intermediate transfer belt 11, which is described in the above embodiments, exemplary modifications and the like may be adapted to the cleaning part 105K for cleaning the photosensitive drum 31K.

3. Cleaner

According to the above embodiments, the cleaning brush is used as the cleaner of the present invention. However, the cleaner of the present invention may be anything, as long as part of the cleaner remains deformed for a while from being in contact with the image carrier for a long period of time. One example of such a cleaner is an elastic material made by a sponge, rubber, and the like.

4. Cleaning Current (1) Quiescent Period of Brush

In the above embodiments, if the quiescent period of the brush is equal to or longer than a predetermined time period, the cleaning current supplied during the image formation that follows after such a quiescent period is set lower than the cleaning current supplied after the normal quiescent period. Specifically, the cleaning current is supplied at a first current value if the quiescent period falls within a first time period, and at a second current value if the quiescent period falls within a second time period.

However, the cleaning current may be set in such a way that different values of the cleaning current correspond to different lengths of the quiescent period of the cleaning brush. The following describes an exemplary modification 4.

Figure 14:
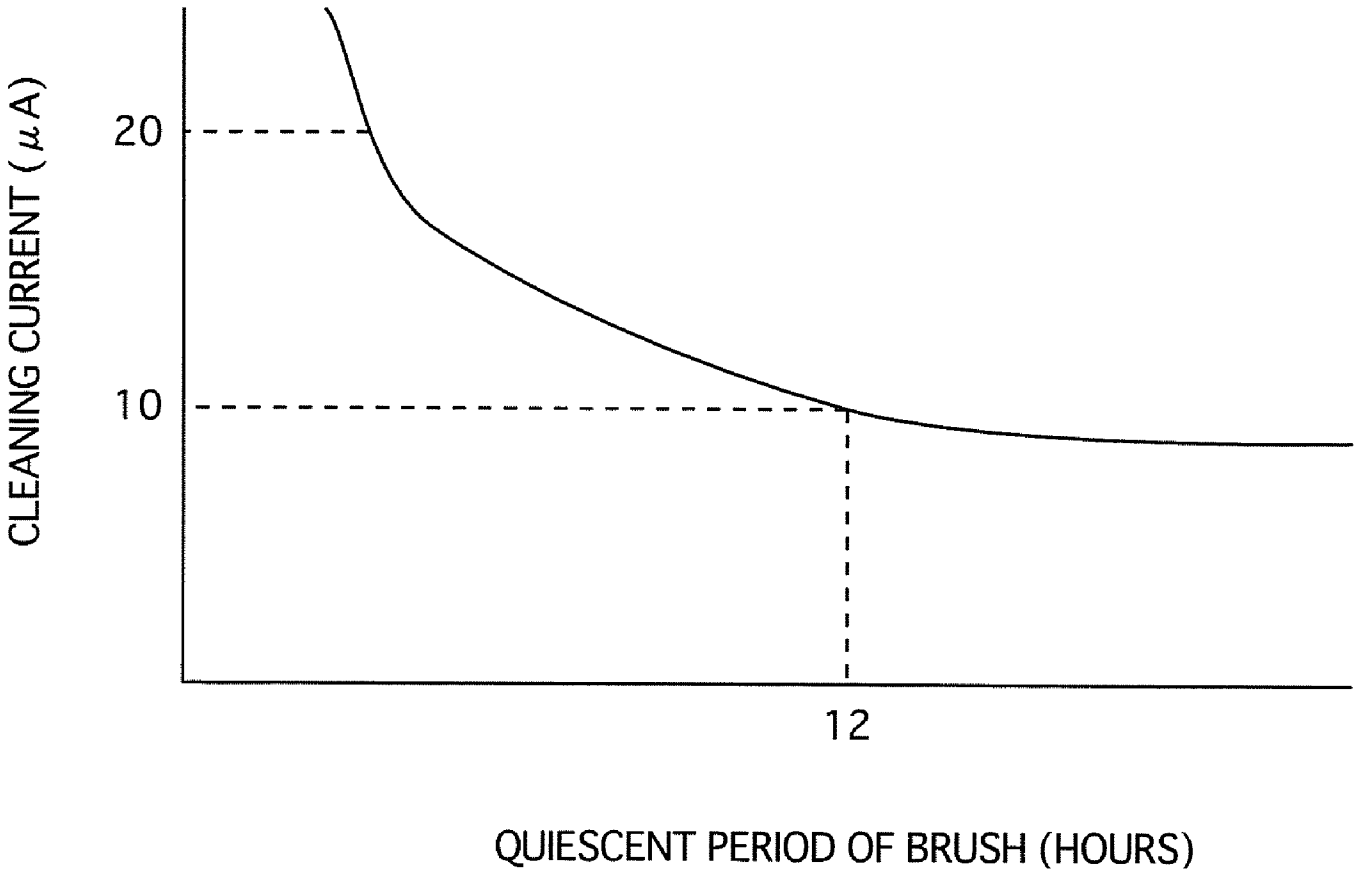
FIG. 14 is a graph showing a relationship between a time period for which a cleaning brush has not rotated and a cleaning current pertaining to an exemplary modification 4.

FIG. 14 is a graph showing a relationship between a quiescent period of the cleaning brush and a cleaning current pertaining to the exemplary modification 4.

A control unit pertaining to the exemplary modification 4 either obtains or calculates the quiescent period (e.g., calculates the difference between T1 and T2, which are obtained in Step S105 of FIG. 9). The control unit sets the cleaning current in such a way that it corresponds to the quiescent period as shown in FIG. 14.

Figure 15:
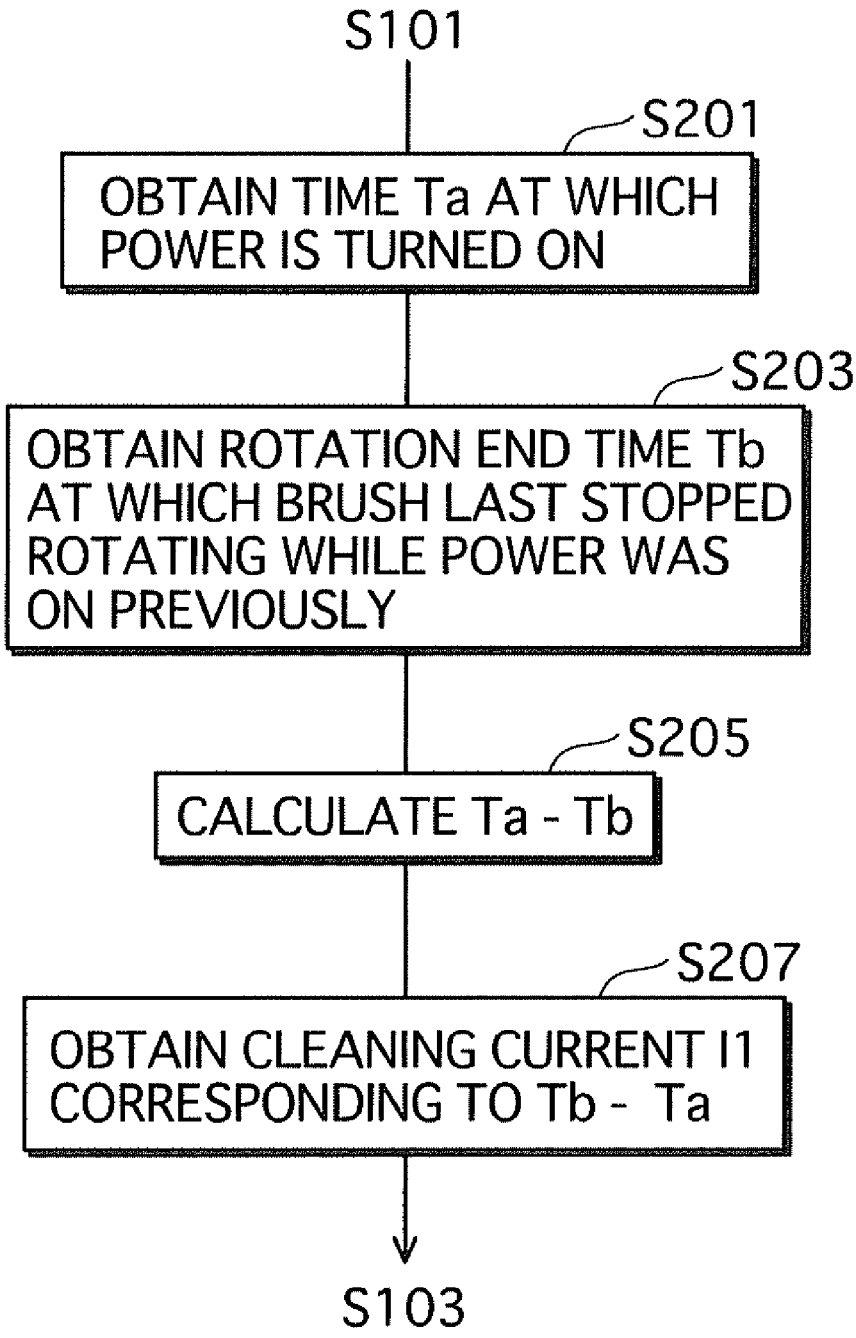
FIG. 15 shows a flowchart of a process performed by a control unit pertaining to an exemplary modification 4.

FIG. 15 shows a flowchart of a process performed by the control unit pertaining to the exemplary modification 4.

The control unit of the exemplary modification 4 is the equivalent of the control unit of the second embodiment. In the exemplary modification 4, the cleaning current is set to correspond to the quiescent period of the cleaning brush. Only the features that are different from the flowchart shown in FIG. 9 are described below.

The control unit pertaining to the exemplary modification 4 performs Steps S201, S203, S205 and S207 shown in FIG. 15, between Steps S101 and S103 of the flowchart shown in FIG. 9.

First, the control unit obtains (i) a time Ta at which the power of the printer is turned on (Step S201) and (ii) a rotation end time Tb of the cleaning brush 82 at which the cleaning brush 82 last stopped rotating while the power of the printer was on most recently (Step S203). Then, the control unit calculates a quiescent period of the cleaning brush 82—i.e., the difference between Ta and Tb (S205), and obtains a cleaning current I1 corresponding to the calculated quiescent period (Ta−Tb) (Step S207).

The cleaning current I1 obtained in Step S207 is used in Step S115 shown in FIG. 9.

For example, provided that different lengths of the quiescent period and different values of the cleaning current are stored in a table in such a way that they correspond to each other as shown in FIG. 14, and that the table is stored in ROM and the like, the cleaning current I1 can be obtained in Step S207 by, for example, reading a current value corresponding to the quiescent period that is calculated in Step S205 from the table.

Following Step S129 of the flowchart shown in FIG. 9, the control unit of the exemplary modification 4 stores, in an involatile memory, a latest rotation end time Tb of the cleaning brush 82 at which the cleaning brush 82 last stopped rotating while the power of the printer has been currently on. The control unit then ends the process.

Note that the latest rotation end time Tb of the cleaning brush 82, at which the cleaning brush 82 last stopped rotating while the power of the printer has been currently on, is equivalent to the rotation end time T2 of Step S133 shown in FIG. 9.

(2) Environment Around Cleaner

According to the above embodiments, the judgment on whether or not the cleaning brush has been in the long quiescent period is made with reference to a time period for which the cleaning brush has not rotated. However, in making such a judgment, the environment around the cleaning brush may be taken into account.

FIG. 16 shows exemplary criteria for judging whether or not the cleaning brush has been in the long quiescent period, with environmental parameters added thereto.

As illustrated in the above embodiments, the cleaner is a brush made of fibers or an elastic material. These materials that make up the cleaner are susceptible to air temperature and humidity. More specifically, high temperature and high humidity tend to, for example, soften the fibers that make up the cleaning brush, and facilitate the bent part of the cleaning brush reverting to the unbent state. In contrast, low temperature and low humidity tend to harden the fibers and delay the bent part of the cleaning brush from reverting to the unbent state.

Thus, under high temperature and high humidity, the criterion for the above judgment, which is the time period shown as "Tref" in FIG. 4 and "Tref1" in FIG. 9 (hereinafter, simply "criterion time period"), is set shorter, specifically to 12 hours. On the other hand, under low temperature and low humidity, the criterion time period is set longer, specifically to 48 hours.

The following describes an exemplary modification 5, in which the aforementioned environmental conditions are taken into account.

Figure 17:
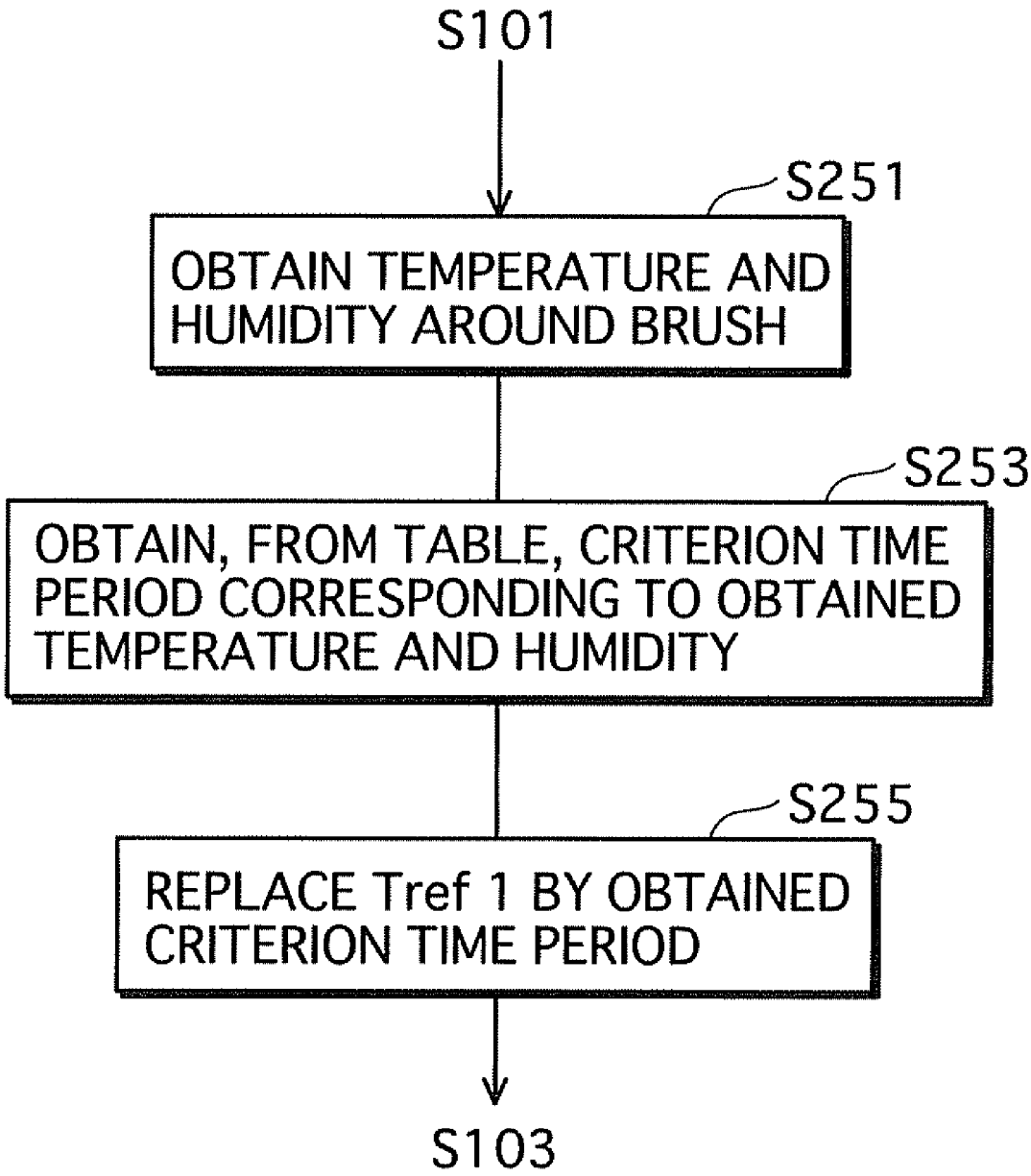
FIG. 17 shows a flowchart of a process performed by a control unit pertaining to an exemplary modification 5.

FIG. 17 shows a flowchart of a process performed by a control unit pertaining to the exemplary modification 5.

The control unit of the exemplary modification 5 is the equivalent of the control unit of the second modification. In the exemplary modification 5, environmental parameters are added to criteria for judging whether or not the cleaning brush has been in the long quiescent period. Between Steps S101 and S103 of the flowchart shown in FIG. 9, the control unit performs Steps S251, S253 and S255 shown in FIG. 17.

The control unit obtains (i) temperature and humidity around the cleaning brush (Step S251) and (ii) a criterion time period corresponding to the obtained temperature and humidity from, for example, the table shown in FIG. 16 (Step S253). The control unit replaces "Tref1" by the obtained criterion time period (Step S255). The obtained criterion time period is used in Step S109 in judging whether or not the cleaning brush has been in the long quiescent period.

In order to implement the exemplary modification 5, a temperature sensor and a humidity sensor should be provided near the cleaning brush 82. Here, the control unit obtains information on temperature and humidity from the aforementioned temperature and humidity sensors, and obtains a criterion time period from a table like the one shown in FIG. 16, the table being stored in ROM and the like.

5. Program

The above embodiments have described the image forming apparatus and the like. It is possible to store, in a machine-readable recording medium, a program that is capable of making the image forming apparatus to execute the operations described in the above embodiments. In such a case, it is probable that the recording medium will be distributed as merchandise in trade.

Further, the aforementioned program can be (i) distributed via a network and the like as merchandise in trade, (ii) installed via the network on a client's terminal, or (iii) displayed on a display device or printed as a hard copy so as to be presented to a user.

Examples of the machine-readable recording medium include, but are not limited to, a floppy disk, a CD, an MO, a DVD, a removable recording medium such as a memory card, a hard disk, and a fixed recording medium such as a semiconductor memory.

6. Combination

Although the foregoing has not particularly described the embodiments and exemplary modifications in terms of their connection with one another, it is permissible to appropriately combine any of the embodiments and the exemplary modifications. The above embodiments and exemplary modifications may be combined with other modifications that are outside of the description herein as well.

7. Summary

The above embodiments are provided to solve the problem mentioned in the (2) RELATED ART section. A summary of the above embodiments is given below.

One aspect of the image forming apparatus of the present invention is an image forming apparatus comprising (i) an image carrier operable to, by rotation thereof, transfer a toner image applied to a surface thereof to a recording medium, (ii) a residual toner cleaner operable to remove toner particles that remain on the surface of the image carrier after the transfer, by rotation of a cleaning member which is in contact with the surface of the image carrier and rotated in accord with the transfer, and (iii) a current supplier operable to supply a cleaning current to the cleaning member in accord with the rotation of the cleaning member, wherein the current supplier supplies the cleaning current at a first current value when the cleaning member has not rotated for less than a predetermined period of time, and at a second current value that is smaller than the first current value when the cleaning member has not rotated for the predetermined period of time or longer.

The above "image carrier" includes a transfer belt (including an intermediate transfer belt and the like), a photosensitive drum, and so forth. By "supply a cleaning current to the cleaning member", it indicates not only that the cleaning current is supplied directly to the cleaning member, but also that the cleaning current can be supplied indirectly to the cleaning member via another component. Furthermore, by "at a second current value that is smaller than the first current value", it means that this cleaning current may have a current value of "0".

Further, the second current value has been set depending on a condition pertaining to an environment in proximity to the cleaning member when the toner image is transferred.

The above "condition pertaining to the environment" includes temperature and humidity. Accordingly, the above "condition pertaining to the environment" may be a condition of temperature only, a condition of humidity only, or a condition of temperature and humidity combined.

Further, after being supplied at the second current value, the cleaning current is gradually restored over time from the second current value to the first current value.

With the term "gradually," the above includes a case where, provided the cleaning current is restored over time from the second current value to the first current value step-by-step, different amounts of time elapsed are in one-to-one correspondence with different values of the cleaning current, in such a way that a graph indicating a relationship between the amount of time elapsed and the value of the cleaning current will show a curved or straight line.

Further, a low-current period, during which the cleaning current is supplied at the second current value, progresses until a deformed part of the cleaning member is restored back to an undeformed state, the deformed part resulting from the cleaning member not having rotated for the predetermined period of time or longer.

Or, the above image forming apparatus further comprises a driver operable to drive and rotate the image carrier, wherein when the driver drives and rotates the image carrier without the transfer of the toner image, the current supplier supplies the cleaning current at the first current value to the cleaning member that rotates in accord with the rotation of the image carrier.

According to the above, "the driver drives and rotates the image carrier without the transfer of the toner image". Here, the image carrier may be driven and rotated for a predetermined period of time, or a predetermined number of times. In the latter case, the image carrier may be rotated once or multiple times.

Meanwhile, one aspect of an image forming method pertaining to the present invention is an image forming method used in an image forming apparatus that (i) applies a toner image on a surface of an image carrier in order to form an image, (ii) transfers the applied toner image to a recording medium by rotation of the image carrier, and (iii) removes toner particles that remain on the surface of the image carrier after the transfer by rotation of a cleaning member, which is in contact with the surface of the image carrier and rotated in accord with the transfer while receiving a cleaning current, wherein the cleaning current is supplied to the cleaning member at a first current value when the cleaning member has not rotated for less than a predetermined period of time, and at a second current value that is smaller than the first current value when the cleaning member has not rotated for the predetermined period of time or longer.

Meanwhile, one aspect of a recording medium pertaining to the present invention is a recording medium for storing therein a program that makes an image forming apparatus to perform processing, wherein (i) the image forming apparatus includes: an image carrier operable to, by rotation thereof, transfer a toner image applied to a surface thereof; a residual toner cleaner operable to remove toner particles that remain on the surface of the image carrier after the transfer, by rotation of a cleaning member which is in contact with the surface of the image carrier and rotated in accord with the transfer; and a current supplier operable to supply a cleaning current to the cleaning member in accord with the rotation of the cleaning member, and (ii) the processing includes the steps of: judging whether or not the cleaning member has not rotated for a predetermined period of time or longer; and instructing the current supplier to supply the cleaning current at a first current value when it is judged in the judging step that the cleaning member has not rotated for less than the predetermined period of time, and at a second current value that is smaller than the first current value when it is judged in the judging step that the cleaning member has not rotated for the predetermined period of time or longer.

Although the present invention has been fully described by way of examples with reference to the accompanying drawings, it is to be noted that various changes and modifications will be apparent to those skilled in the art.

Therefore, unless otherwise such changes and modifications depart from the scope of the present invention, they should be constructed as being included therein.

What is claimed is:

1. An image forming apparatus comprising:

an image carrier operable to, by rotation thereof, transfer a toner image applied to a surface thereof to a recording medium;

a residual toner cleaner operable to remove toner particles that remain on the surface of the image carrier after the transfer, by rotation of a cleaning member which is in contact with the surface of the image carrier and rotated in accord with the transfer; and a current supplier operable to supply a cleaning current to the cleaning member in accord with the rotation of the cleaning member, wherein the current supplier supplies the cleaning current at a first current value when the cleaning member has not rotated for less than a predetermined period of time, and at a second current value that is smaller than the first current value when the cleaning member has not rotated for the predetermined period of time or longer.

2. The image forming apparatus of claim 1, wherein the second current value has been set depending on a condition pertaining to an environment in proximity to the cleaning member when the toner image is transferred.

3. The image forming apparatus of claim 2, wherein after being supplied at the second current value, the cleaning current is gradually restored over time from the second current value to the first current value.

4. The image forming apparatus of claim 3, wherein a low-current period, during which the cleaning current is supplied at the second current value, progresses until a deformed part of the cleaning member is restored back to an undeformed state, the deformed part resulting from the cleaning member not having rotated for the predetermined period of time or longer.

5. The image forming apparatus of claim 4, further comprising:

a driver operable to drive and rotate the image carrier, wherein when the driver drives and rotates the image carrier without the transfer of the toner image, the current supplier supplies the cleaning current at the first current value to the cleaning member that rotates in accord with the rotation of the image carrier.

6. The image forming apparatus of claim 1, wherein after being supplied at the second current value, the cleaning current is gradually restored over time from the second current value to the first current value.

7. The image forming apparatus of claim 1, wherein a low-current period, during which the cleaning current is supplied at the second current value, progresses until a deformed part of the cleaning member is restored back to an undeformed state, the deformed part resulting from the cleaning member not having rotated for the predetermined period of time or longer.

8. The image forming apparatus of claim 1, further comprising:

a driver operable to drive and rotate the image carrier, wherein when the driver drives and rotates the image carrier without the transfer of the toner image, the current supplier supplies the cleaning current at the first current value to the cleaning member that rotates in accord with the rotation of the image carrier.

9. An image forming method used in an image forming apparatus that (i) applies a toner image on a surface of an image carrier in order to form an image, (ii) transfers the applied toner image to a recording medium by rotation of the image carrier, and (iii) removes toner particles that remain on the surface of the image carrier after the transfer by rotation of a cleaning member, which is in contact with the surface of the image carrier and rotated in accord with the transfer while receiving a cleaning current, wherein the cleaning current is supplied to the cleaning member at a first current value when the cleaning member has not rotated for less than a predetermined period of time, and at a second current value that is smaller than the first current value when the cleaning member has not rotated for the predetermined period of time or longer.

10. The image forming method of claim 9, wherein the second current value has been set depending on a condition pertaining to an environment in proximity to the cleaning member when the toner image is transferred.

11. The image forming method of claim 9, wherein after being supplied at the second current value, the cleaning current is gradually restored over time from the second current value to the first current value.

12. The image forming method of claim 9, wherein a low-current period, during which the cleaning current is supplied at the second current value, progresses until a deformed part of the cleaning member is restored back to an undeformed state, the deformed part resulting from the cleaning member not having rotated for the predetermined period of time or longer.

13. The image forming method of claim 9 comprising:

a driver operable to drive and rotate the image carrier, wherein when the driver drives and rotates the image carrier without the transfer of the toner image, the cleaning current is supplied at the first current value to the cleaning member that rotates in accord with the rotation of the image carrier.

14. A recording medium for storing therein a program that makes an image forming apparatus to perform processing, wherein the image forming apparatus includes:

an image carrier operable to, by rotation thereof, transfer a toner image applied to a surface thereof;

a residual toner cleaner operable to remove toner particles that remain on the surface of the image carrier after the transfer, by rotation of a cleaning member which is in contact with the surface of the image carrier and rotated in accord with the transfer; and a current supplier operable to supply a cleaning current to the cleaning member in accord with the rotation of the cleaning member, and the processing includes the steps of:

judging whether or not the cleaning member has not rotated for a predetermined period of time or longer; and instructing the current supplier to supply the cleaning current at a first current value when it is judged in the judging step that the cleaning member has not rotated for less than the predetermined period of time, and at a second current value that is smaller than the first current value when it is judged in the judging step that the cleaning member has not rotated for the predetermined period of time or longer.

* * * * *